US010899422B2

(12) United States Patent
Schmidt et al.

(10) Patent No.: US 10,899,422 B2
(45) Date of Patent: Jan. 26, 2021

(54) AUTONOMOUS SUBMERSIBLE OFFSHORE MARINE PLATFORM

(71) Applicants: Terrence W. Schmidt, Santa Clara, CA (US); Jeffrey E. Kline, Severna Park, MD (US)

(72) Inventors: Terrence W. Schmidt, Santa Clara, CA (US); Jeffrey E. Kline, Severna Park, MD (US)

( * ) Notice: Subject to any disclaimer, the term of this patent is extended or adjusted under 35 U.S.C. 154(b) by 0 days.

(21) Appl. No.: 16/732,715

(22) Filed: Jan. 2, 2020

(65) Prior Publication Data

US 2020/0140047 A1 May 7, 2020

Related U.S. Application Data

(63) Continuation of application No. 16/190,219, filed on Nov. 14, 2018, now abandoned.

(60) Provisional application No. 62/587,008, filed on Nov. 16, 2017.

(51) Int. Cl.

| | |
|---|---|
| ***B63B 1/10*** | (2006.01) |
| ***B63G 8/00*** | (2006.01) |
| ***B63B 35/44*** | (2006.01) |
| *B63C 11/42* | (2006.01) |
| *B63B 21/50* | (2006.01) |

(52) U.S. Cl.

CPC ..... *B63G 8/001* (2013.01); *B63B 1/107* (2013.01); *B63B 35/44* (2013.01); *B63B 21/50* (2013.01); *B63B 2021/505* (2013.01); *B63C 11/42* (2013.01); *B63G 2008/004* (2013.01)

(58) Field of Classification Search

CPC ..... B63B 1/107; B63B 2035/007; B63B 2207/02; B63B 43/06; B63G 2008/004

See application file for complete search history.

(56) References Cited

U.S. PATENT DOCUMENTS

| | | | | |
|---|---|---|---|---|
| 6,131,531 | A * | 10/2000 | McCanna | B63B 22/18 114/331 |
| 6,877,450 | B2 * | 4/2005 | Schmidt | B63B 1/04 114/61.13 |
| 7,219,613 | B2 * | 5/2007 | Root, Jr. | B63B 1/107 114/61.15 |
| 7,685,957 | B2 * | 3/2010 | Schmidt | B63B 1/107 114/258 |

(Continued)

*Primary Examiner* — Andrew Polay

(57) ABSTRACT

It is an object of the present invention to provide a means of constructing an Autonomous fully-Submersible Offshore Marine Platform (ASOMP) of considerable warfighting or commercial capability which is mobile and can autonomously transport to a hazardous operating area in a low-observable reduced vulnerability manner, fully submerge to avoid the military or environmental threat hazard, hibernate until needed, perform fully submerged mobility and mission operations, surface and provide Barge and SWATH surface ship mobility and mission operations, resubmerge if the hazardous threat appears and relocate to a new operating area. Another object of the present invention is to provide a fully autonomous and submersible low-cost "lily-pad" that surfaces when called and provides a main deck platform at appropriate freeboard and seakeeping motions to function as a refueling landing zone and pier to extend the range of aircraft and marine vehicles operating in a high-threat environment.

28 Claims, 25 Drawing Sheets

(56) References Cited

U.S. PATENT DOCUMENTS

| | | | | |
|---|---|---|---|---|
| 8,763,546 | B2 * | 7/2014 | Brizzolara | B63B 1/14 114/61.14 |
| 9,017,123 | B2 * | 4/2015 | Szydlowski | B63B 25/08 441/4 |
| 9,327,811 | B2 * | 5/2016 | Sancoff | B63G 8/001 |
| 10,167,065 | B2 * | 1/2019 | Swift | B63B 13/00 |

* cited by examiner

AUTONOMOUS SUBMERSIBLE OFFSHORE MARINE PLATFORM

CROSS REFERENCES TO RELATED APPLICATIONS

Provisional application No. 62/587,008 filed on 16 Nov. 2017 with Amendment 1 (30 Jan. 2018), Amendment 2 (8 Mar. 2018) and Amendment 3 (29 Mar. 2018).

FEDERALLY SPONSORED RESEARCH

None

BACKGROUND OF THE INVENTION

Traditional surface offshore marine platforms are uniquely capable of providing payload-capable, low-motion main decks for at-sea aviation flight operations, mission systems operations and logistic distribution to other surface vessels and ashore elements for low-level hazardous areas. Unfortunately, these platforms are designed to operate only on the water surface and cannot escape from the hazard by operating fully-submerged which makes them extremely vulnerable to military and environmental threats. This vulnerability results in the need for the surface offshore marine platforms to be large and expensive and require significant crew and capabilities to minimize susceptibility to a hazardous area's damage and casualty. When the operating environment's hazardous threat level increases beyond the capabilities of the surface offshore marine platform due to an increase in a military adversary's offensive capability or extreme weather conditions the surface offshore marine platform must be moved outside the range of the military or environmental threat resulting in a loss of military or commercial mission capability and availability.

The present invention relates to an Autonomous fully-Submersible Offshore Marine Platform that can be operated: (1) on the water surface as a Barge (large waterplane area) surface platform having a large payload capacity for floating pier operations; (2) on the water surface as a SWATH (Small Waterplane Area Twin Hull) surface platform providing a main deck platform at appropriate freeboard and with low seakeeping motions to support aviation flight operations; and (3) as an underwater fully-Submersible (Barge or SWATH) for undersea mobility, hibernation, and relocation to avoid the military or environmental threat. More particularly, the present invention relates to an Autonomous fully-Submersible Offshore Marine Platform (ASOMP) which: (1) is transported near to a hazardous operating area; (2) autonomously submerges and maneuvers underwater to avoid the potential threat or environmental hazard; (3) autonomously forward-deploys (pre-positions) to an operational location and "hibernates" or loiters until needed; (5) when remote commanded through a secure communication link, autonomously maneuvers below the surface as a Barge or surfaces to the water surface as Barge or SWATH; (6) autonomously performs its operational mission; (7) autonomously (or when remote commanded) resubmerges if a hazardous threat appears or when mission is completed; and (8) is redeployed to a new operating area. Operationally, the ASOMP is unmanned and organically "low-value" to further lower the risk for military or commercial missions without fear of catastrophic damages or attrition due to military adversary or environment/weather threats and hazards. Modular mission capabilities can be incorporated into the ASOMP's main deck internal pressure vessels or cross-decked using modular pressure vessels on top of the main deck to support fully-submerged operations and provide protection against the submerged hydro-static pressures. The Autonomous fully-Submersible Offshore Marine Platform can also serve as an episodic "lily-pad" to provide infiltration capable services (for landing, docking, fueling and logistics staging) when the ASOMP is commanded to the surface and extend the range of manned or unmanned aircraft and marine vehicles that operate in a high-threat environment to what-ever distance is needed while keeping the high-value, surface offshore marine platforms that launched them out of "harm's way. The Autonomous fully-Submersible Offshore Marine platform can also transport, launch/recover and sustain unmanned air, surface and underwater vehicles and mission packages, which are of limited range, so that they are close enough to their respective operating area to enable effective employment in a high threat environment while keeping the high-value, surface offshore marine platforms that would traditionally be needed to transport and launch them out of "harm's way".

BRIEF SUMMARY OF THE INVENTION

It is an object of the present invention to provide an Autonomous fully-Submersible Offshore Marine Platform (ASOMP) of considerable capability which can be transported to a hazardous operating area in a reduced vulnerability manner, autonomously fully submerge to avoid the military or environmental threat, autonomously perform fully submerged mobility and mission operations, autonomously hibernate until needed, on command autonomously surface and provide Barge and SWATH surface ship mobility and mission operations, rapidly re-submerge if the hazardous threat appears and autonomously relocate to a new operating area to continue mission operations. The ASOMP is an autonomous unmanned platform and organically "low value" with high value propulsion and mission capabilities added as required. In this way, the ASOMP can be configured based on mission requirements, deployed and submerged (pre-positioned) for long-periods of time without fear of high value capability failures, destruction or loss due to seizure (theft). Operationally, the ASOMP's autonomous ability to rapidly submerge, maneuver undersea, hibernate, surface, re-submerge and relocate provides a unique capability for a surface Barge or SWATH platform to effectively perform episodic (appears when needed and disappears when not) military or commercial infiltration missions in high threat areas and limit exposure to catastrophic damages due to military or environment. Operationally, the ASOMP:

- Is fueled at a forward base and is transported to the operating area by organic power, or by separate Unmanned Underwater Vehicles (UUVs) or by unmanned/manned tugs;
- Autonomously maneuvers, submerges and prepositions itself on the ocean floor to hibernate;
- When commanded (remote or autonomously) moves to a submerged operating depth or on-the-surface for autonomous operational use as either a Barge or SWATH platform;
- When configured as a Barge, the Main Deck Platform waterline can be below the water surface for launch/recovery and support of underwater vehicles;
- When configured as a Barge, the Main Deck Platform waterline can support large payload, Roll-on, Roll-off Discharge Facility (RRDF) pier operations inclusive of launch/recovery, refueling and resupply of amphibious vehicles and surface craft;

When configured as a SWATH, the Main Deck Platform freeboard can support low motion operations as a Landing Zone and refueling/resupply base for manned and unmanned aircraft;

Is configured so that the Main Deck Platform can house internal pressure vessels to store high pressure gas for ballasting operations and avoid the use of pumps;

Is configured with a ballasting system wherein venting air from ballast tanks is reused by directing and storing said venting air into a Pressure Vessel (PV) where the PV air pressure is less than the ballast tank venting air pressure and when the ballast tank air pressure is lower than any ASOMP PV the air is vented into the seaway. In this way, fully submersible operations can be extended without the use of an air compressor;

Is configured so that a portion of the Main Deck Pressure Vessels can provide diesel generator intake air or oxygen and store exhaust gas for electric propulsion when in a full-submerged state to augment the batteries and extend the fully-submerged range and fully-submerged operations endurance;

Is configured so that the Main Deck Platform can house internal pressure vessels to store, launch and provide hotel capabilities for unmanned underwater vehicles, unmanned surface or amphibious vehicles, unmanned air vehicles, logistics or mission equipment;

Is configured so that the Main Deck Platform can accommodate external reconfigurable modular pressure vessels to store, launch and provide hotel capabilities for unmanned underwater vehicles, unmanned surface or amphibious vehicles, unmanned air vehicles, logistics or mission equipment;

Is configured so that it can store large quantities of fuel for refueling of manned and unmanned vehicles; and When commanded (remote or autonomously) rapidly submerges and repositions to avoid a military or environmental threat and continue autonomous missions.

Another object of the present invention is to provide an autonomous and fully submersible low-cost "lily-pad" that surfaces when called and provides a main deck platform at appropriate freeboard and seakeeping motions to function as a refueling/resupply landing zone and pier to extend the range of aircraft and marine vehicles operating in a high-threat environment while keeping the high-value surface offshore marine platforms that traditionally transport them out of "harm's way".

Another object of this invention is to provide a means to transport, launch/recover and sustain unmanned air, surface and underwater vehicles and mission packages, which are of limited range, so that they are close enough to their respective operating area to enable effective employment in a high threat environment while keeping the high-value, surface offshore marine platforms that would traditionally be needed to transport and launch them out of "harm's way".

Another object of the present invention is to provide an autonomous fully submersible, offshore marine platform with a main deck platform of sufficient size and extremely low motions to ocean seaways to support aircraft landings and takeoffs, surface craft operations and other mission capabilities.

Yet another object of the present invention is to provide a means to effectively pre-position an autonomous submersible offshore marine platform that can reconfigure into a submersible Barge or SWATH or a surface Barge or SWATH and maneuver in a low visibility and low risk manner into a hazardous operating area for use when needed.

Yet another object of the present invention is to provide a means for the ASOMP to protect its high-value mission capabilities when performing submerged operations to depths greater than 1000 feet.

Yet another object of the present invention is to provide a way to populate or repopulate the ASOMP with mission capabilities when deployed in the hazardous operating area.

Yet another object of the present invention is to provide for an underwater mobility (sub-surface snorkeling and/fully submerged air independent propulsion) and submergence to make it difficult, time consuming and expensive to locate by competitors.

Yet another object of the present invention is to provide for a low-resistance surface and submerged platform to minimize respective surface and fully submerged propulsion and anchoring load requirements.

Yet another object of the present invention is to provide a low-cost autonomous submersible offshore marine platform for island perimeter maritime security to include the features identified.

Yet another object of the invention is to provide a fuel/energy source for the ASOMP propulsion to extend its operational range and endurance both on the surface and fully submerged.

Yet another object of the invention is to provide a high-value, modular mission package integration strategy using manned/unmanned underwater vehicles and surface vehicles for reduced observability to the hazardous threat to reduce vulnerability.

Yet another object of the invention is to provide an autonomous submersible offshore marine platform for commercial use in support of oil exploration, energy harvesting, etc. In these commercial applications more traditional offshore deployment strategies including being towed to operational site can be used.

Yet another object of the invention is to provide an autonomous submersible offshore marine platform for commercial use in support of oil exploration, energy harvesting, etc. In these commercial applications more traditional offshore station keeping strategies such as being moored or thrusters to maintain position can be used.

Yet another object of the invention is to provide an autonomous submersible offshore marine platform for commercial use in support of oil exploration, energy harvesting, etc. In these commercial applications high value capabilities can be organically included initially and or populated/removed using traditional surface vessels and techniques.

DETAILED DESCRIPTION OF THE INVENTION

Figure 1:
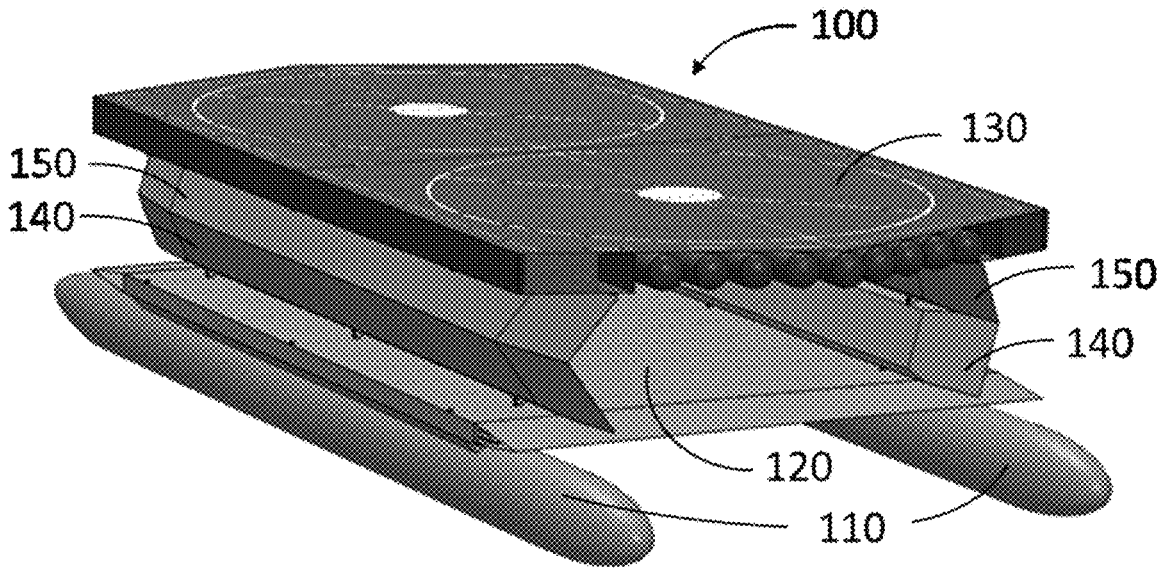
FIG. 1 shows a perspective view of the Autonomous Submersible Offshore Marine Platform, of the present invention, configured as a Mobile Undersea Base (MUB) used by the military to refuel vertical take-off and landing aircraft.
Figure 2:
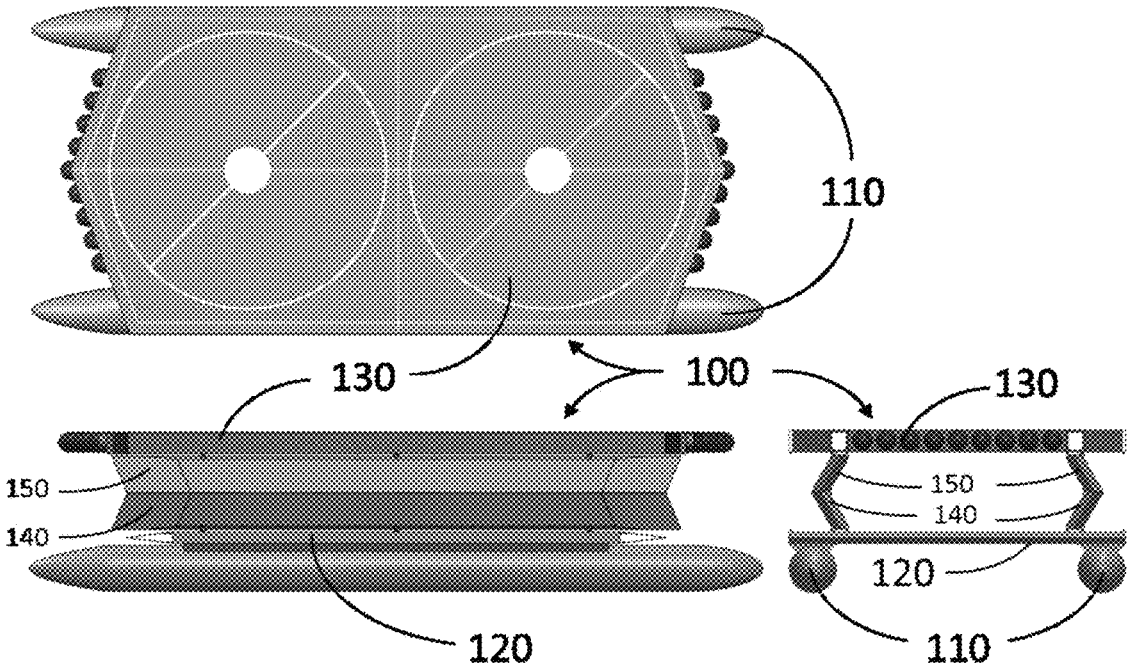
FIG. 2 shows three views of the Autonomous Submersible Offshore Marine Platform configured as a SWATH vessel for operating on the ocean surface.
Figure 3:
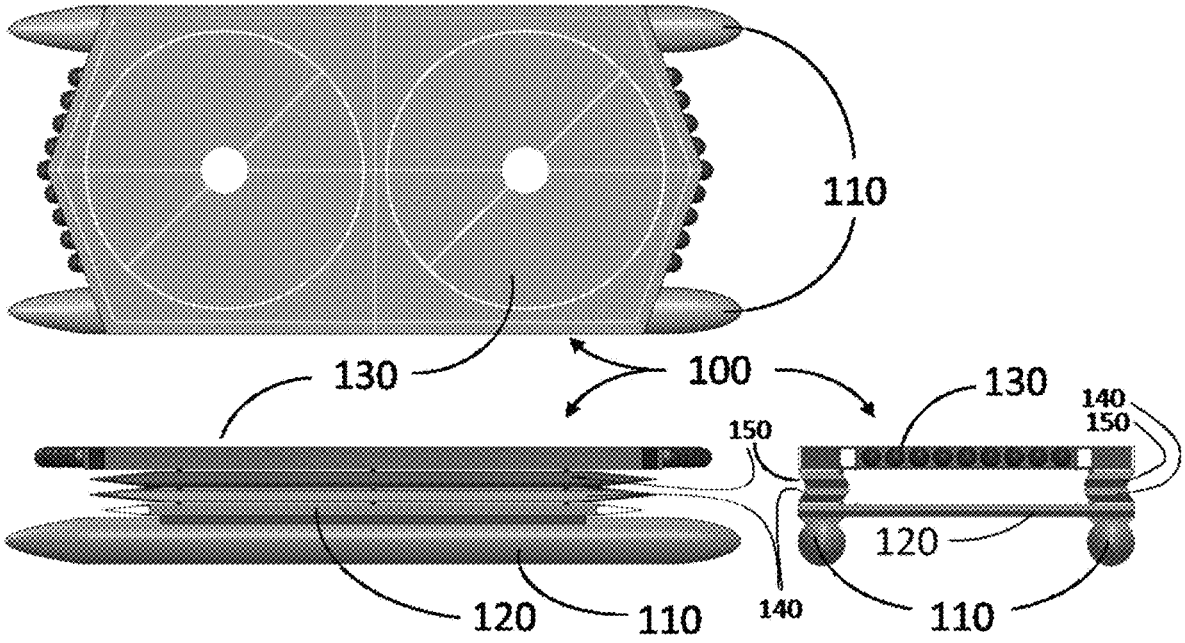
FIG. 3 shows three views of the Autonomous Submersible Offshore Marine Platform configured as a Barge for transiting and operations on the ocean surface, transiting submerged below the ocean surface, and hibernating on the ocean floor.
Figure 4:
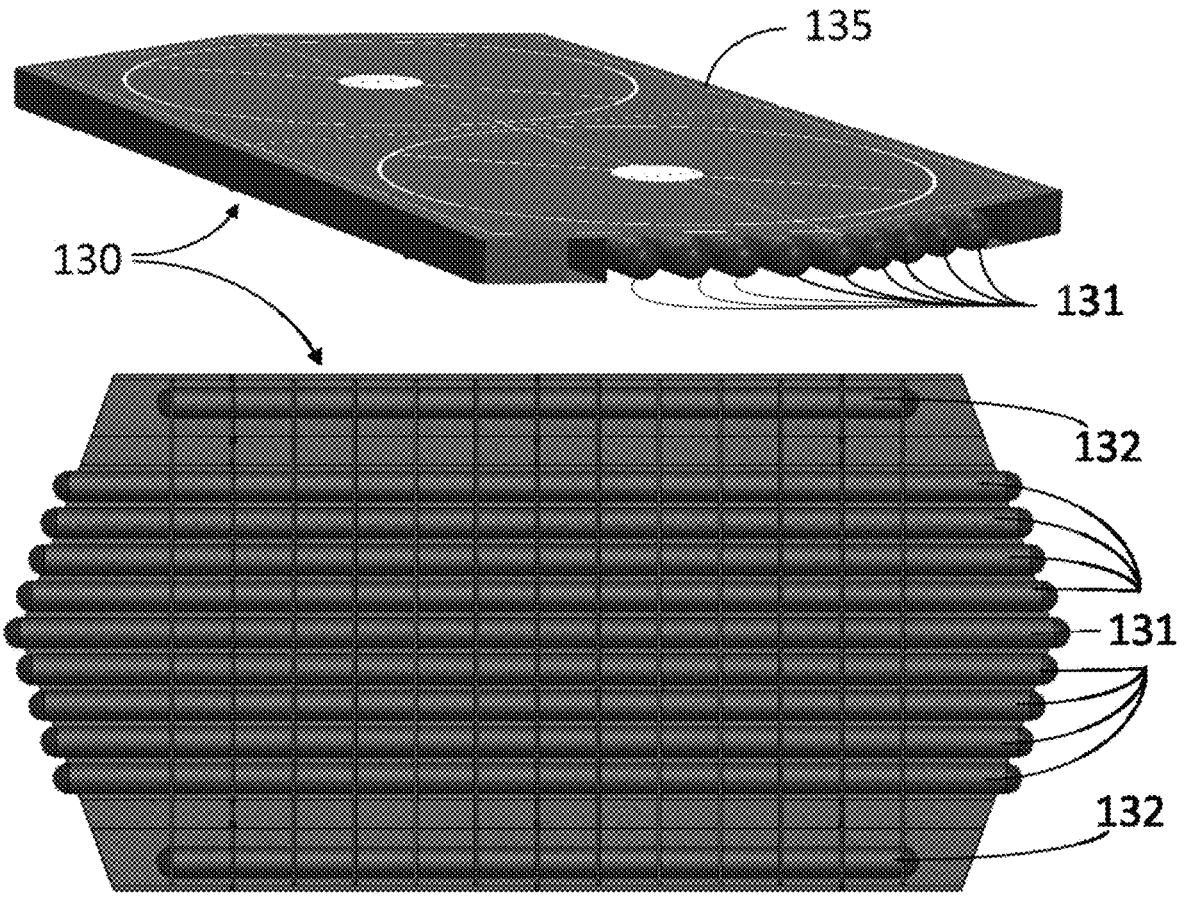
FIG. 4 is a perspective and an upward looking view of the Autonomous Submersible Offshore Marine Platform's Main Deck Platform.
Figure 5:
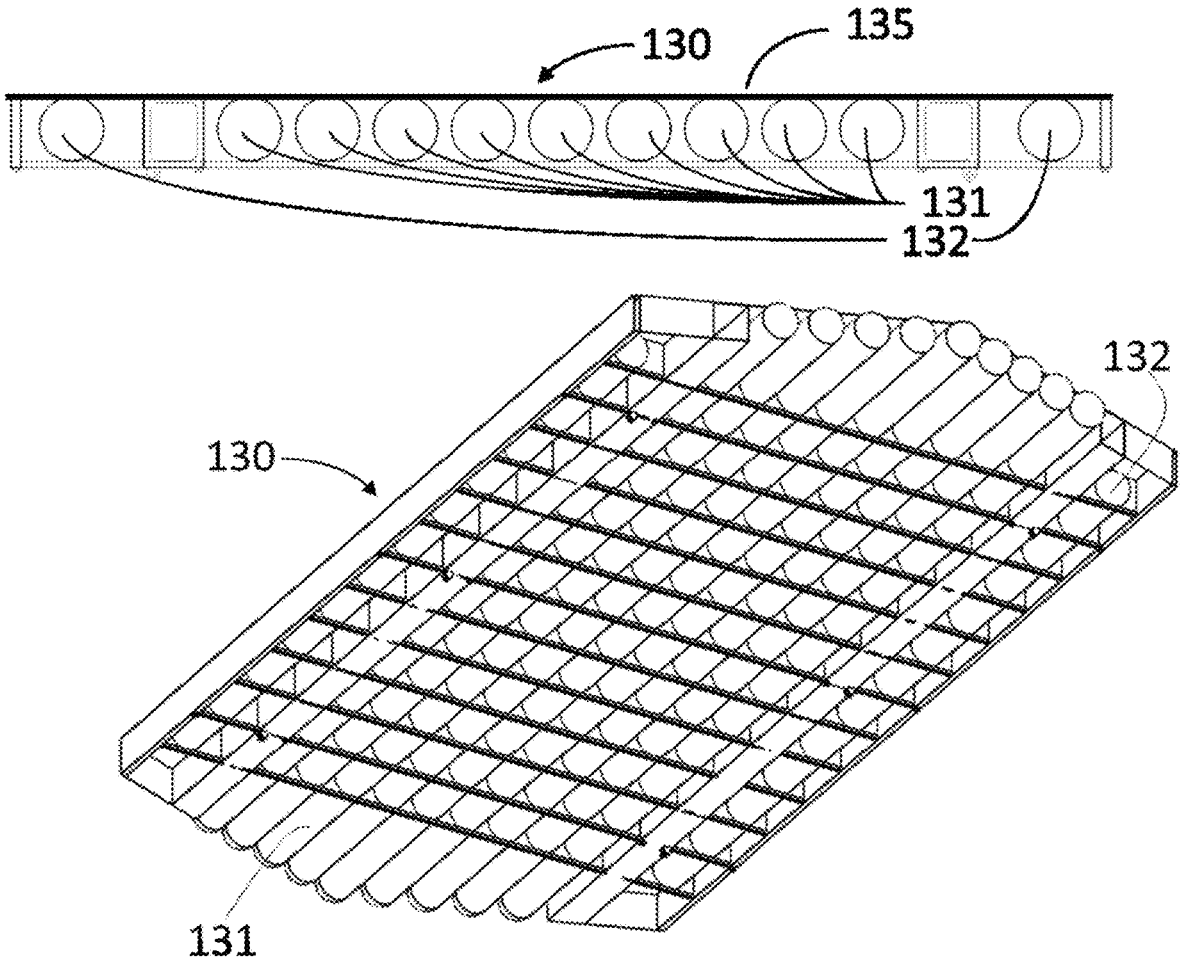
FIG. 5 is a perspective drawing and midship section drawing showing the Autonomous Submersible Offshore Marine Platform's Main Deck Platform.

Referring now to the drawings in detail, Page 1 FIG. 1 illustrates an example of an Autonomous fully-Submersible Offshore Marine Platform (referred to as the ASOMP) 100, constructed in accordance with the present invention that operates as both a surface platform and submersible, with the ability to hibernate for extended periods of time on the seafloor. The ASOMP 100 is comprised of 4 major portions:

a. A Lower Hull 110 portion with at least two submerged pod shaped Lower Hulls 110 that provide a substantial portion of the ASOMP's buoyancy. Said Lower Hulls 110 are of pressure vessel form able to withstand submergence hydrostatic pressures. Tanks within said Lower Hulls provide a ballast capacity sufficient to submerge and surface the ASOMP.

b. A Cross Structure portion 120 connecting said Lower Hulls. Said Cross Structure 120 is a primary structural member providing a structural arrangement that significantly reduces hydrodynamic load created stresses of conventional SWATH vessels. Additionally said Cross Structure 120 generates significant hydrodynamic added mass and damping reducing ASOMP's seaway motions. Control surfaces, of known form, can be appended to said Cross Structure 120 for longitudinal and lateral directional control.

c. A Main Deck Platform portion 130 used to support mission equipment and operations. A plurality of Pressure Vessels 131, shown in FIGS. 4 and 5, that provide buoyancy and storage of high pressure air, are a portion of said Main Deck Platform 130. Said Pressure Vessels 131 provide buoyancy that is greater than the Main Deck Platform's 130 weight which along with the Lower Hulls 110 ballasting capacity enables the ASOMP 100 to operate as both a submersible, where the center of buoyancy must be located above the center of gravity, and as a surface vessel where the center of buoyancy is below the center of gravity. Additionally said Main Deck Pressure Vessel 131 buoyancy along with said Lower Hull 110 ballast tanks are used to reconfigure between Barge and SWATH modes of operation. FIGS. 2 and 3 show three views of the ASOMP 100 with the major portions configured as a SWATH FIG. 2 and Barge FIG. 3. Another portion of said Main Deck Platform 130 are Submergence Control Tanks 132 shown in FIGS. 4 and 5 that can be ballasted using tank vents or deballasted using high pressure air stored in said Pressure Vessels 131. Said Submergence Control Tanks 132, are of a soft tank form that do not need to withstand the submergence hydrostatic pressure and are used to submerge the ASOMP 100 from the ocean's surface to the seafloor controlling decent rate, trim and list. Another portion of said Main Deck Platform 130 is the Operational Deck 135 shown in FIGS. 4 and 5 which can be configured to support various mission operations such as a VTOL flight deck or a Roll on Roll off cargo deck.

d. Struts with Upper Strut 150 and Lower Strut 140 portions that are pivotally connected to each other, the Main Deck Platform 130 and the Lower Hulls 110 or Cross Structure 120 are shown in FIGS. 6, 7, 8 and 9. The pivotally connected Strut portions enable the ASOMP 100 to change between Barge and SWATH operational modes by allowing the Main Deck Platform 130 to be raised or lowered with respect to the Lower Hulls 110. The pivotal Upper Strut 150 and Lower Strut 140 portions are locked in position when extended (SWATH configuration) or when folded (Barge configuration). Pivot Locks 171 are released to enable changing between Barge and SWATH operational modes. Extension and folding of said Struts with pivotal portions is accomplished by ballasting or deballasting said Lower Hulls using gas stored in the Main Deck Platform Pressure Vessels. The Struts are designed to avoid requiring actuators to fold the Struts once extended. To enable this, when the struts are in the extended position the Pivots 161 connecting the Upper Strut 150 portion to the Lower Strut 140 portion must be positioned to not go over center which is defined as a line 190 in FIG. 7 between the Pivots 161 connecting the Upper Strut 150 portion to the Main Deck Platform 130 and the Pivots 161 connecting the Lower Strut 140 portion to the Cross Structure 120 or Lower Hulls 110.

Said Upper Strut 150 and Lower Strut 140 portions function as buoyant structures when the ASOMP 100 is operational on the sea surface as a SWATH or Barge. When submerged the Upper Strut 150 and Lower Strut 140 portions are vented allowing them to flood with sea water removing hydrostatic pressure vessel requirements.

Figure 10:
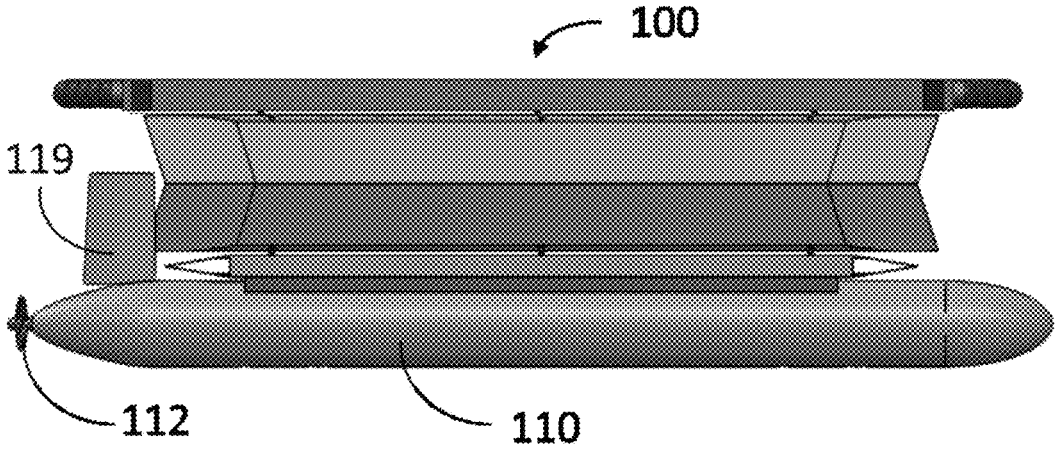
FIG. 10 shows an outboard profile of the ASOMP configured with an integral propulsion system.

FIG. 10 is an outboard profile showing an Autonomous fully-Submersible Offshore Marine Platform (ASOMP) 100 wherein propulsion systems are integral to the ASOMP's Lower Hull 110 portions. When operating on the ocean's surface intake air and exhaust gas are provided by a Snorkel 119 that extends above the ocean's surface. A Propeller 112 is shown as a propulsor that provides thrust for both surface and submerged operations.

Figure 11:
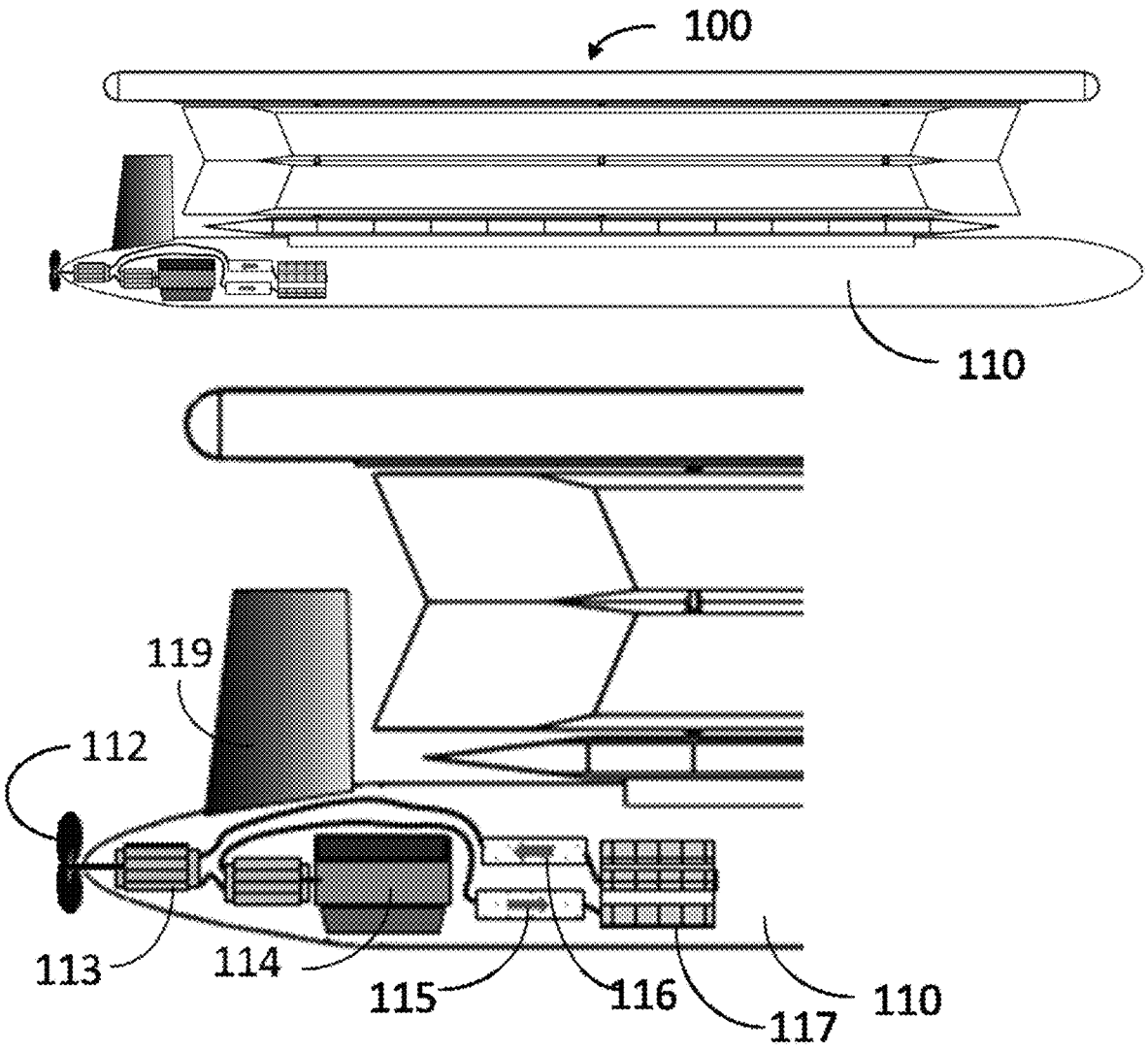
FIG. 11 shows inboard profiles of the ASOMP configured with one means of an integral propulsion system.

FIG. 11 is an inboard profile showing one means of a propulsion system where a Snorkel 119 provides surface intake air from above the ocean's surface into the Lower Hull 110 and exhaust gas from a Diesel Generator 114 to above the ocean's surface when the ASOMP 100 is operating on the ocean's surface. AC power from the diesel generator can directly drive the AC Propulsion Motor 113 and or be stored in Batteries 117 which provides the power for the ASOMP's 100 submerged operations. Power conditioning for the Batteries 117 is provided by an AC to DC Converter 115 and a DC to AC Inverter 116.

Figure 12:
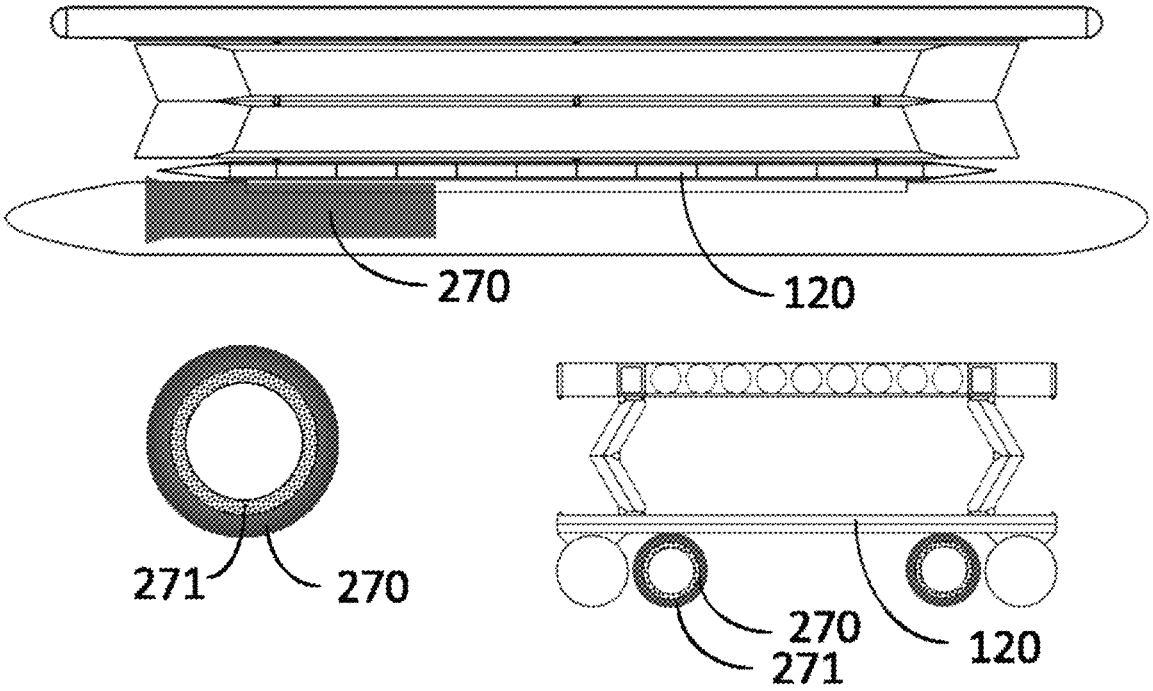
FIG. 12 shows one means for attachment of a UUV for ASOMP Propulsion.
Figure 13:
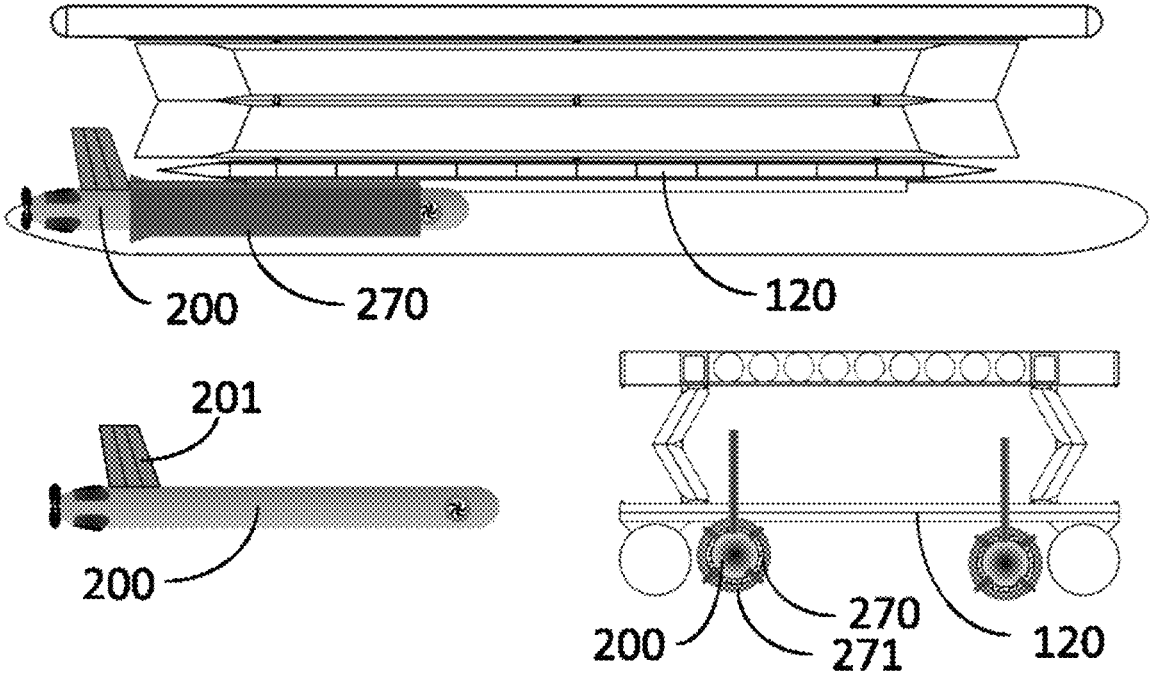
FIG. 13 is an inboard profile and stern elevation view showing two UUV attached to the ASOMP for propulsion. A notional UUV is also shown.

FIGS. 12 and 13 show another means of providing propulsion to transport the ASOMP 100 by using Unmanned Underwater Vehicles (UUVs) 200. FIG. 12 shows Docking Tubes 270 attached to the ASOMP's 100 Cross Structure 120 as one means of connecting the UUVs 200. A plurality of Inflatable Toroidal Capture Seals 271, positioned internal to the Docking Tube 270, are used to secure the UUV 200. FIG. 13, an inboard profile and stern view, shows UUVs 200 positioned and secured within the Docking Tubes 270 that are attached to the Cross Structure 120 of the ASOMP 100. Other known means could also be used to connect the UUVs 200 to the ASOMP's 100 structure. When operating on the ocean's surface the UUVs 200 are powered by a diesel generator and electric propulsion motor allowing an extensive range and endurance. Diesel intake and exhaust air are provided by a Surface Piercing Snorkel 201. When operating in a submerged mode below the ocean's surface the UUVs 200 electric drive motor is powered by batteries. The UUVs battery power can be augmented by connecting to the ASOMP's electrical system Battery 117. After transiting to an operational location, the UUVs 200 are detached from the ASOMP 100 and return to their operational base. The ASOMP 100 can then conduct surface operations or be submerged to ocean floor depths of up to 1000 feet using the autonomous ballasting system. All ASOMP 100 operational control commands can be transmitted from a remote command center through a secure communication link or through the ASOMP's organic autonomous control system.

Figure 14:
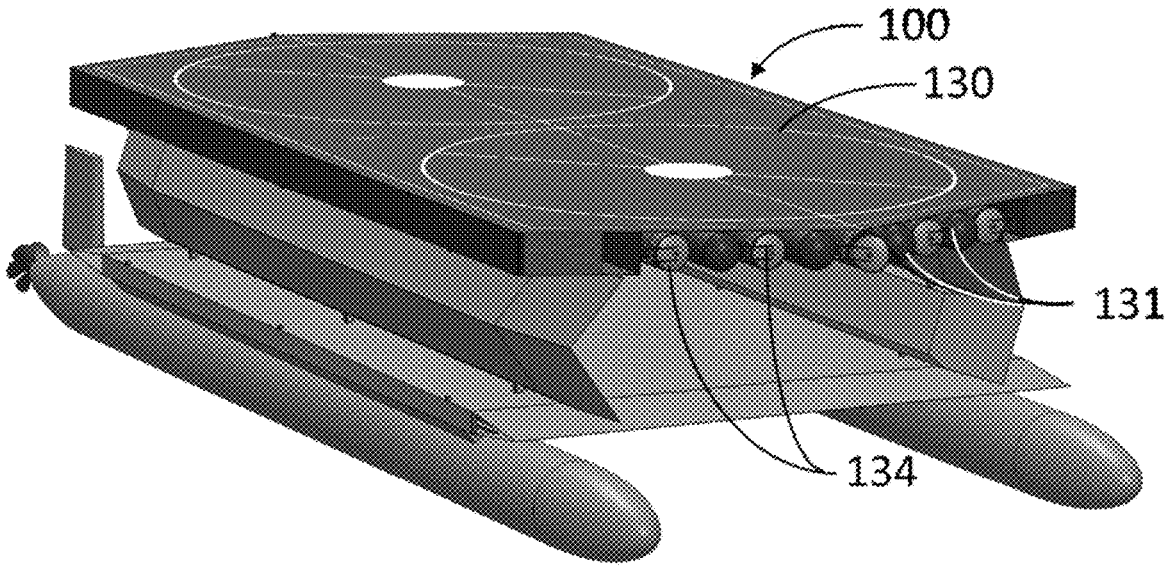
FIG. 14 Is a perspective view of the ASOMP showing Pressure Vessels in the Main Deck Platform with a portion of the Pressure Vessels having hatches allowing for storage of mission related equipment such as unmanned vehicles.
Figure 15:
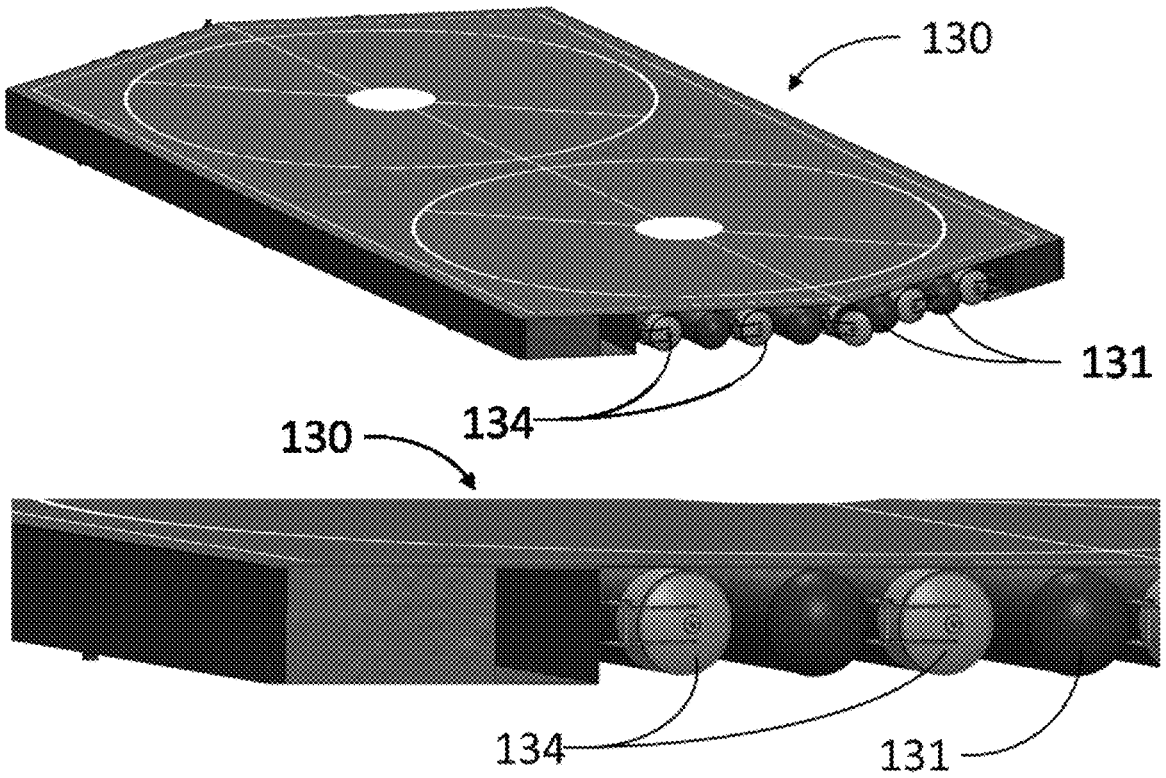
FIG. 15 Shows a portion of the Pressure Vessels in the Main Deck Platform with hatches allowing for storage of mission related equipment such as unmanned vehicles.
Figure 16:
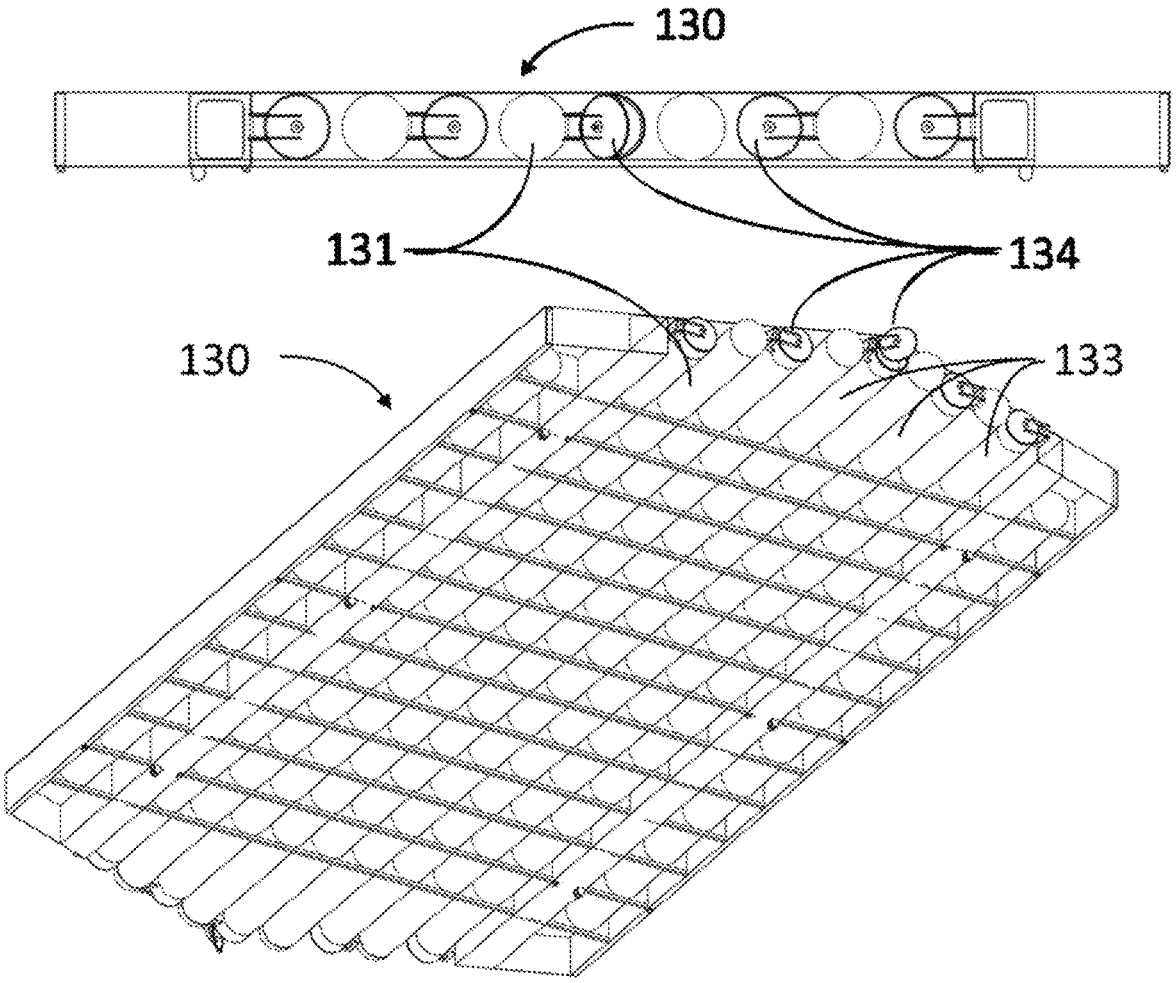
FIG. 16 Is a perspective drawing showing Pressure Vessels in the Main Deck Platform where a portion are for high pressure air storage and a portion have hatches allowing for the storage of mission related equipment. Also shown is an elevation bow view of the Main Deck Platform showing the Air Storage Pressure Vessels and the Pressure Vessels with hatches for storage of mission equipment.
Figure 30:
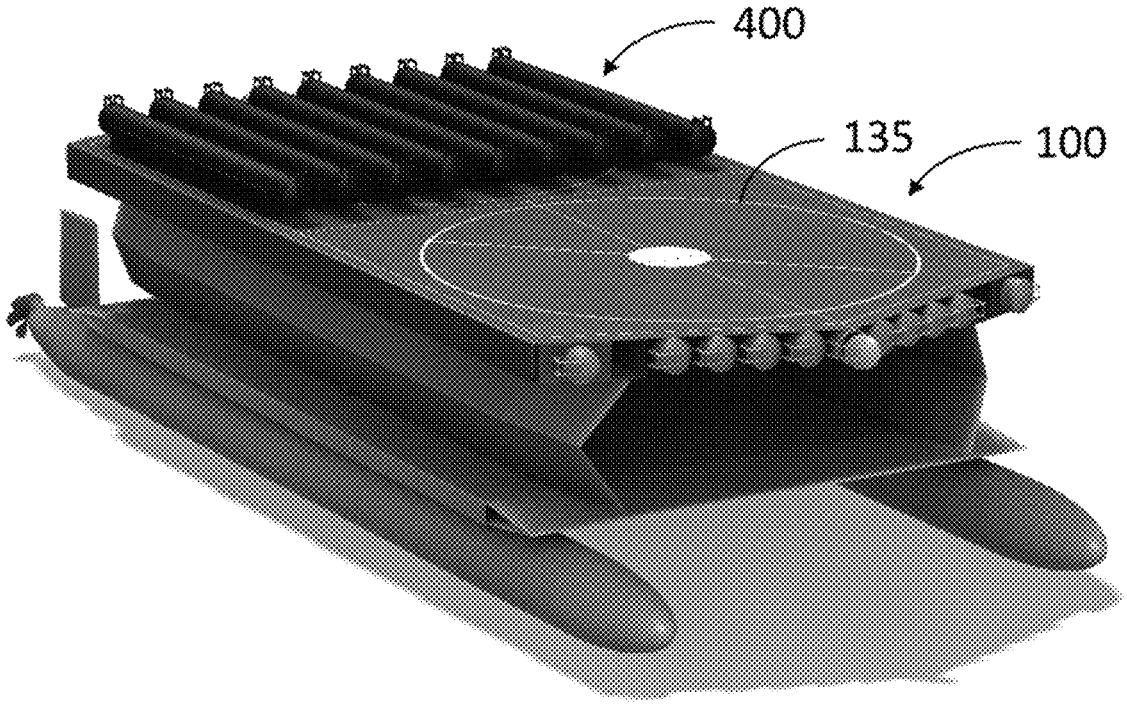
FIG. 30 shows a perspective view of the ASOMP with additional payload Pressure Vessels installed onto the Main Deck Platform.

FIGS. 14, 15 and 16 show various views of an Autonomous fully-Submersible Offshore Marine Platform (ASOMP) 100 and its Main Deck Platform 130 wherein a portion of the Main Deck Platform 130 Pressure Vessels 131 are configured to store high pressure air for ballasting operations and a portion of the Pressure Vessels 133 are configured to contain deployable mission equipment. Pressure Vessel Hatches 134 provide access for loading and deploying the mission equipment. Mission equipment such as Unmanned Underwater Vehicles UUVs can be deployed when the ASOMP is submerged, and Unmanned Surface Vehicles USVs when the ASOMP is surfaced. FIG. 30 shows an Autonomous fully-Submersible Offshore Marine Platform (ASOMP) 130 wherein Mission Modules 400 consisting of Pressure Vessels, Soft Tanks or other equipment can be attached to the Operational Deck 135 of the Main Deck Platform 130. Mission Module Pressure Vessels 400 could be configured as habitability units to support manned ASOMP 100 mission operations such as VTOL aircraft support or as storage for Unmanned Aerial Vehicles UAVs and UAV payloads. A portion of the Main Deck Pressure Vessels could also be configured to provide diesel generator intake air or oxygen and store exhaust gas for diesel-electric propulsion when in a full-submerged state to augment the batteries and extend the ASOMP fully-submerged range and fully-submerged operations endurance. Mission Modules 400 can be attached to the Operational Deck 135 in the operational theater or prior to the ASOMP's 100 deployment.

Figure 17:
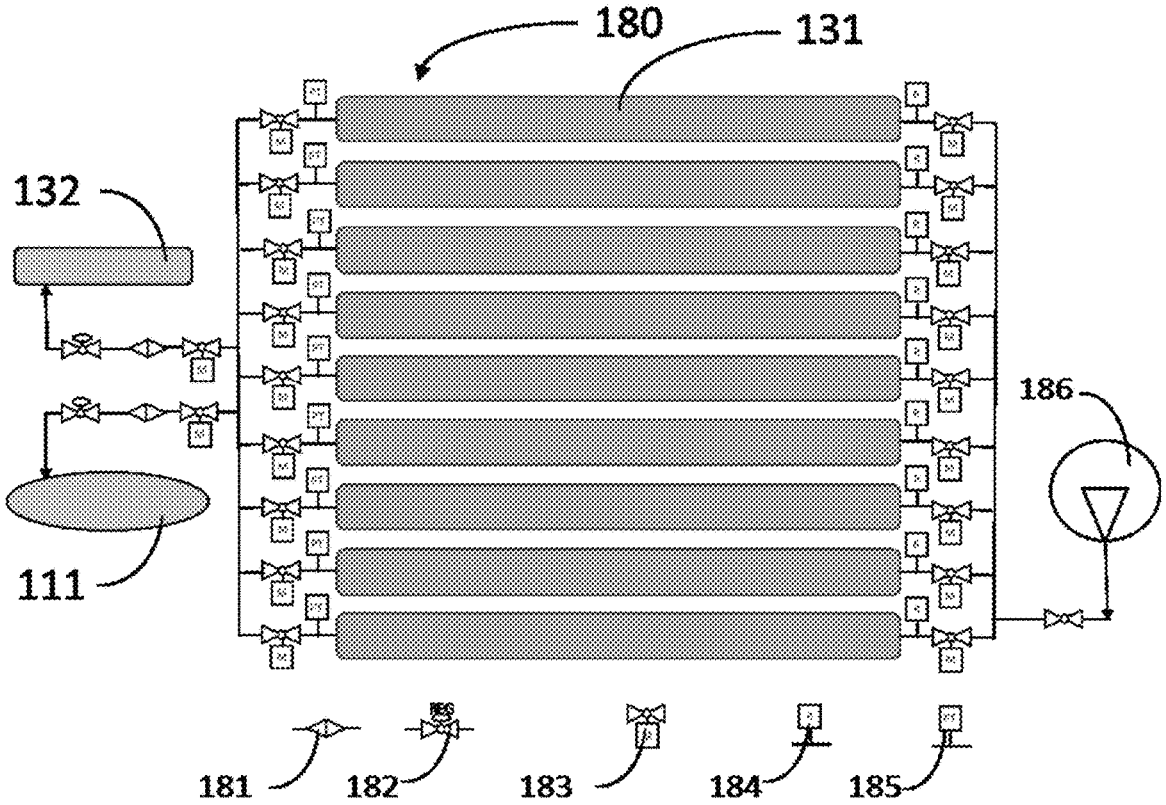
FIG. 17 Is a diagram showing elements of the ASOMP's ballasting system used to submerge, hibernate, hover, surface, fold and unfold the struts converting between SWATH and Barge modes of operation, and adjust Main Deck Platform freeboard to accommodate interfacing with other platforms and varying mission payloads.

FIG. 17 is a diagram of the ASOMP's Ballasting Control System 180 which is comprised of Air Filters 181, Bottom Tracking Pressure Regulators 182, Motorized Ball Valves 183 that control air flow distribution, Relief Valves 184, Pressure Transducers 185 and Air Compressors 186. Air stored in the Pressure Vessels 131 is used to deballast Lower Hull 110 Ballast Tanks 111 and Submergence Control Tanks 132 eliminating the use of ballast pumps. By using high pressure air stored in the Pressure Vessels 131 instead of conventional pumps for deballasting operations the ASOMP can submerge and resurface within minutes as opposed to multiple hours required by conventional ballast pump based ballasting systems and eliminate the pump electrical demands during submerged ballasting. Air stored within the Pressure Vessels 131 must be of a pressure significantly higher than the hydrostatic pressure of the ASOMP's 100 maximum operational depth. For example, an ASOMP 100 operating to a 1000 ft. depth (444 psi hydrostatic pressure) would require Pressure Vessel 131 air to be initially stored at approximately 800 psi or higher to enable the ASOMP's Lower Hull 110 Ballast Tanks 111 and Submergence Control Tanks 132 to be deballasted when at the maximum 1000 ft. operational depth. Initial air storage pressure and the Pressure Vessels' 131 volume determines the number of times the ASOMP could submerge and surface before needing to recharge the Pressure Vessels 131 with the Air Compressor 186. The Ballasting Control System 180 autonomously controls the following ASOMP 100 operational functions:

a. When transiting on the Ocean's surface, when configured as a Barge or SWATH, the Ballasting Control System 180 maintains the commanded draft, trim and list compensating for changes in variable loads such as fuel burn and for hydrodynamic forces including speed dependent sinkage and trim forces and moments.
b. When configured as a Barge and transiting or hovering submerged below the Ocean's surface the Ballasting Control System 180 maintains the commanded submergence depth, trim and list.
c. When configured as a Barge or SWATH and conducting mission operations the Ballasting Control System 180 maintains the commanded draft, trim and list compensating for changes in variable loads such as movement of roll on roll off equipment, VTOL aircraft operations, launching and/or recovery of UUVs and/or USVs from The Main Deck Platform 130 Pressure Vessels 133 and environmental loads including seaway currents and wind.

Figure 18:
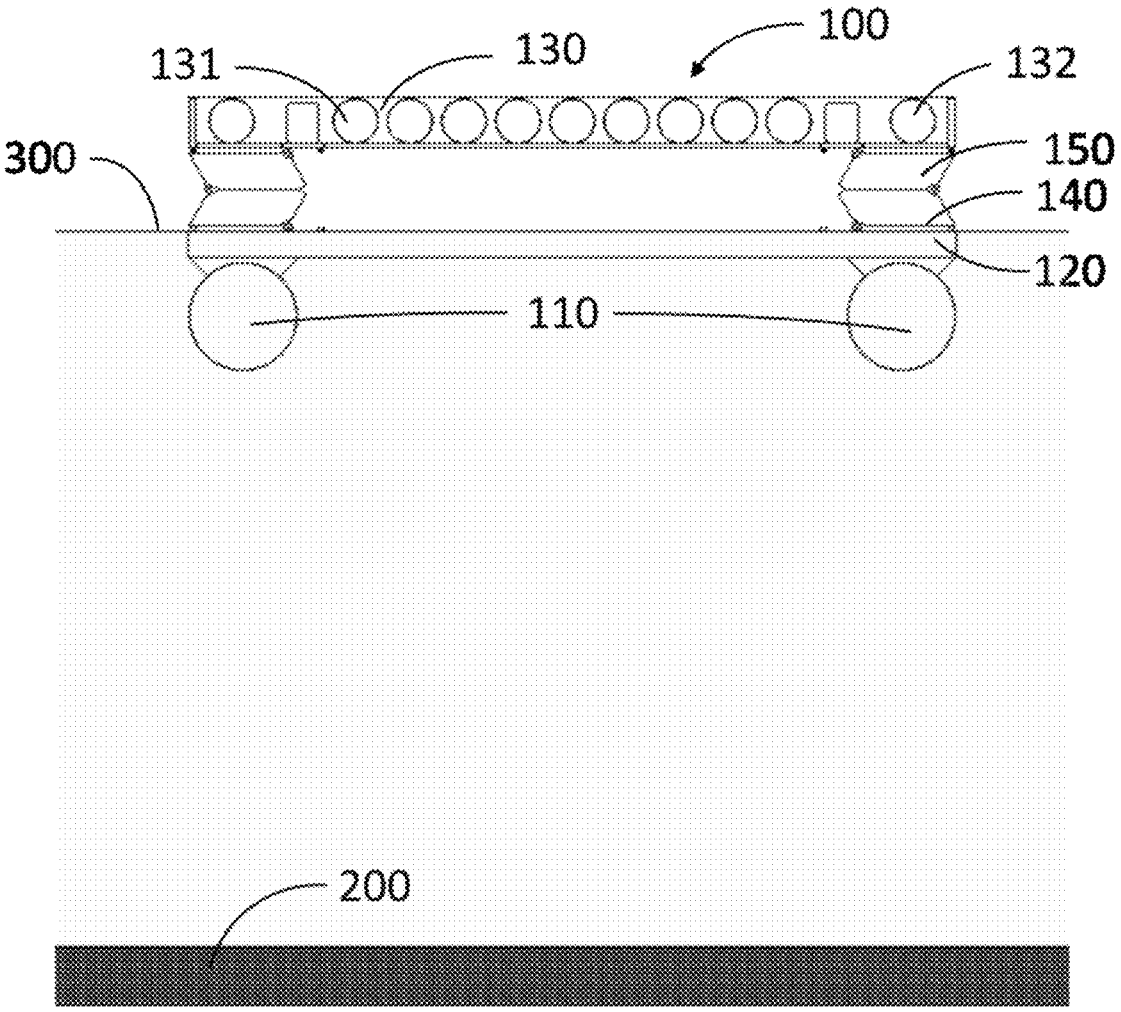
FIGS. 18-24 show the ballasting operations that enables the ASOMP to submerge in a controlled fashion from the ocean's surface to the seafloor.
Figure 19:
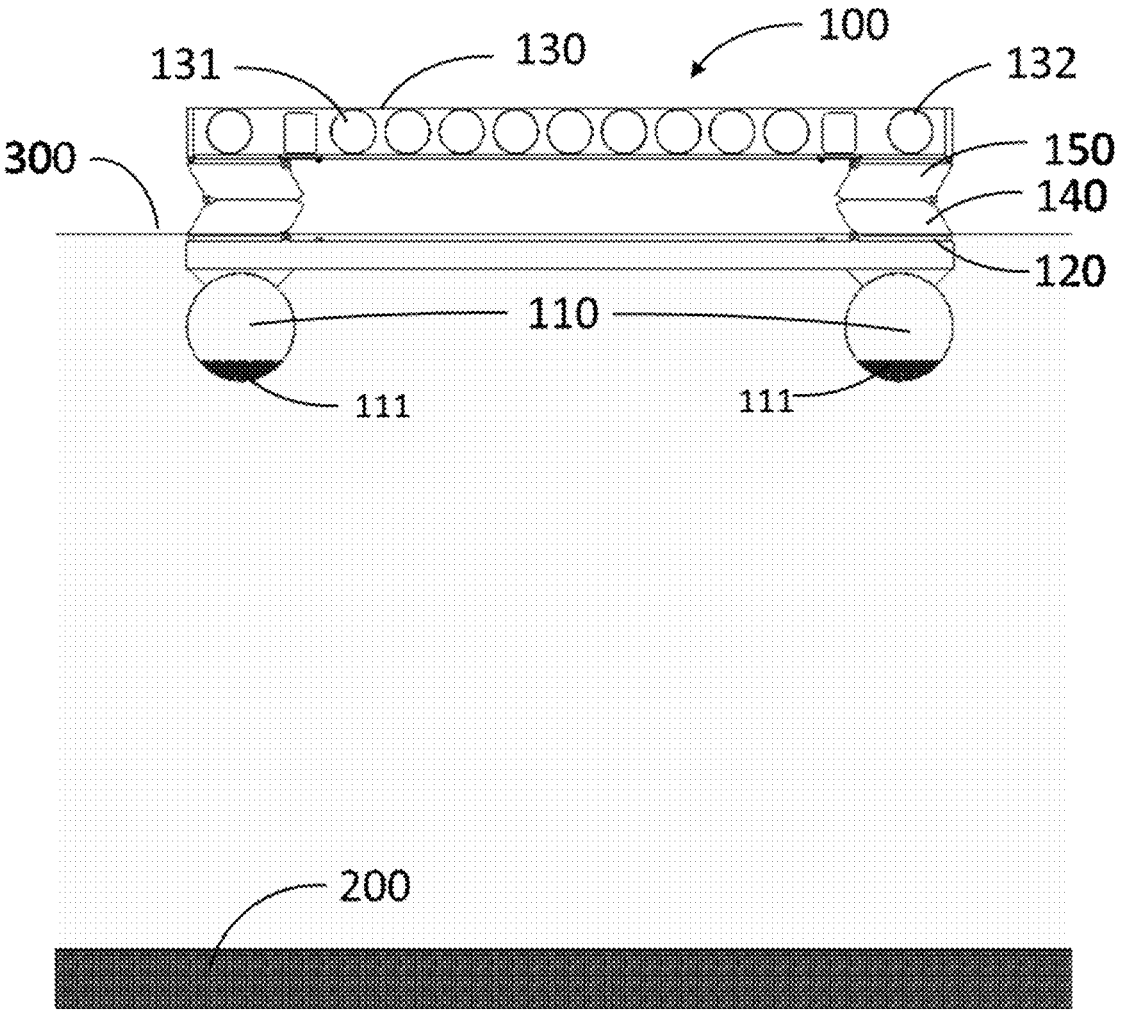
Figure 20:
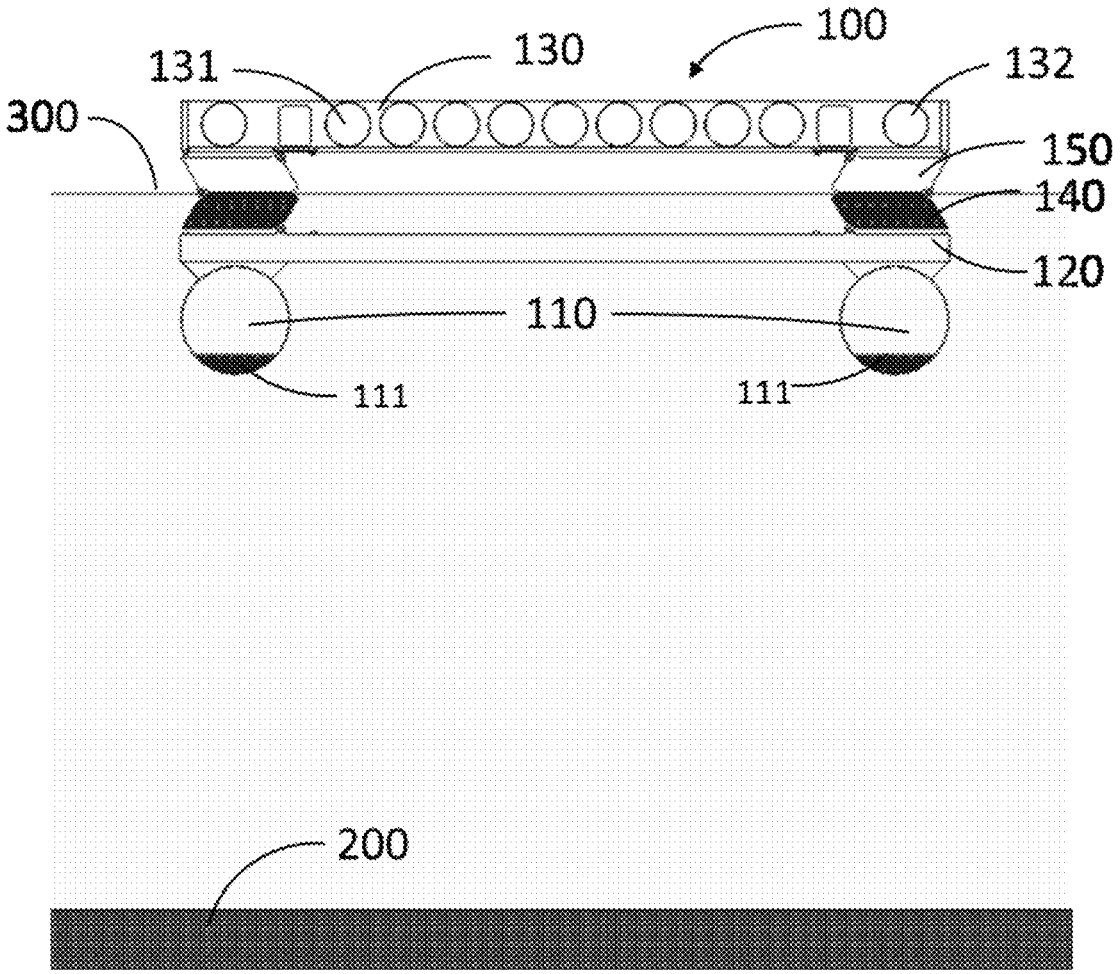
Figure 21:
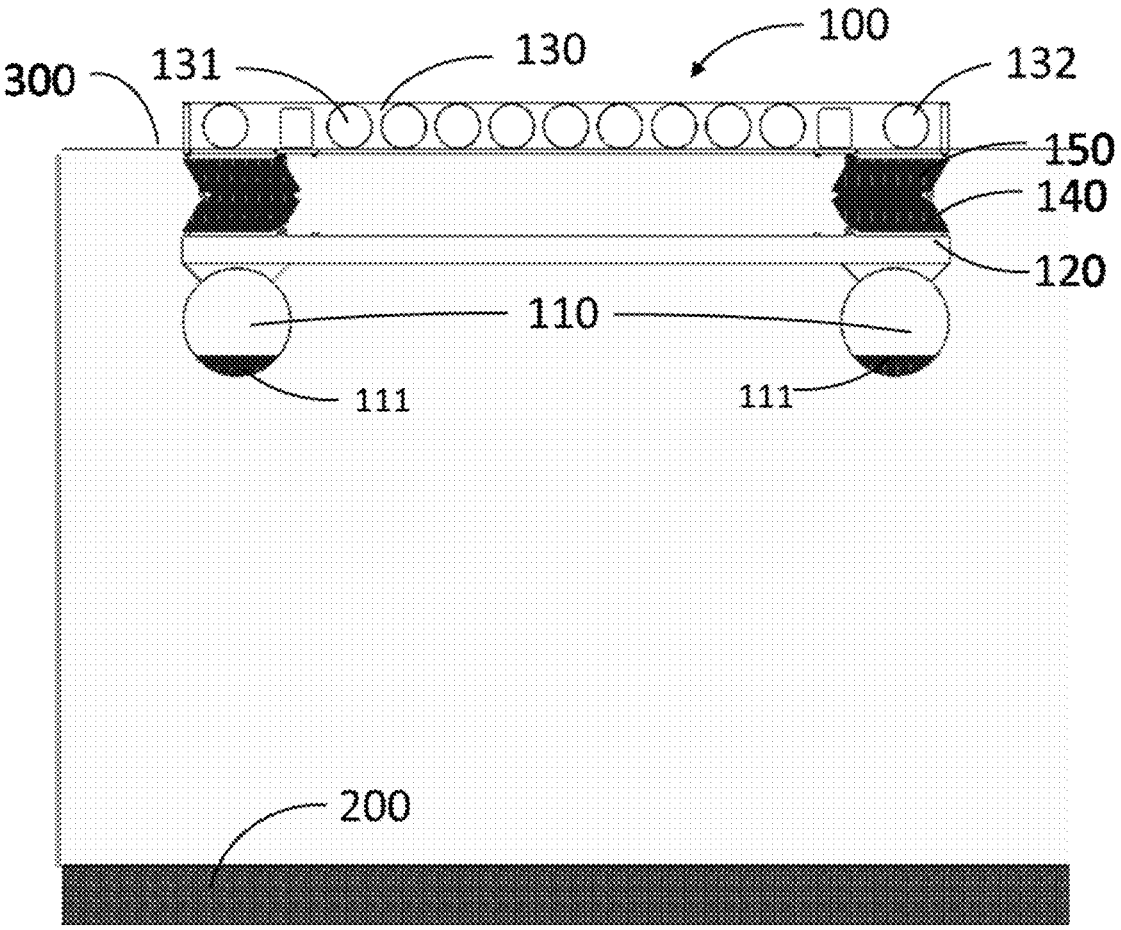
Figure 22:
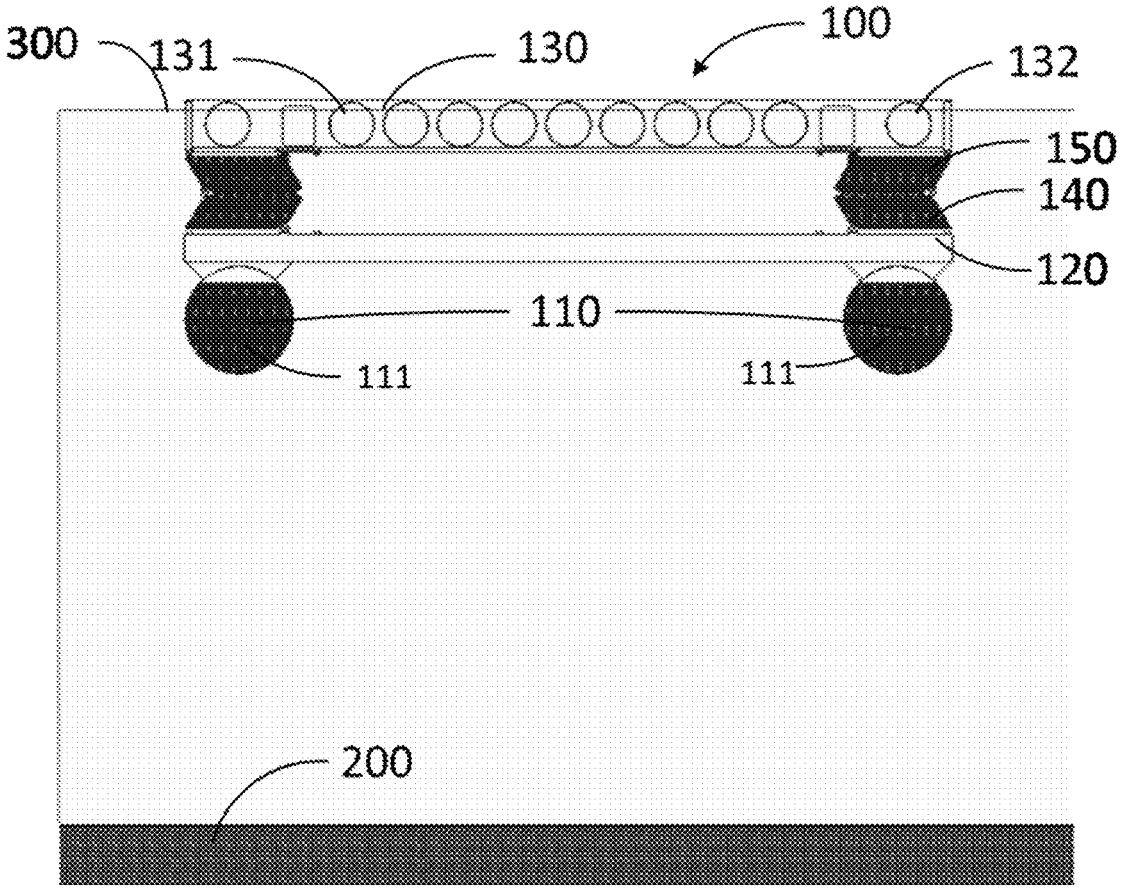
Figure 23:
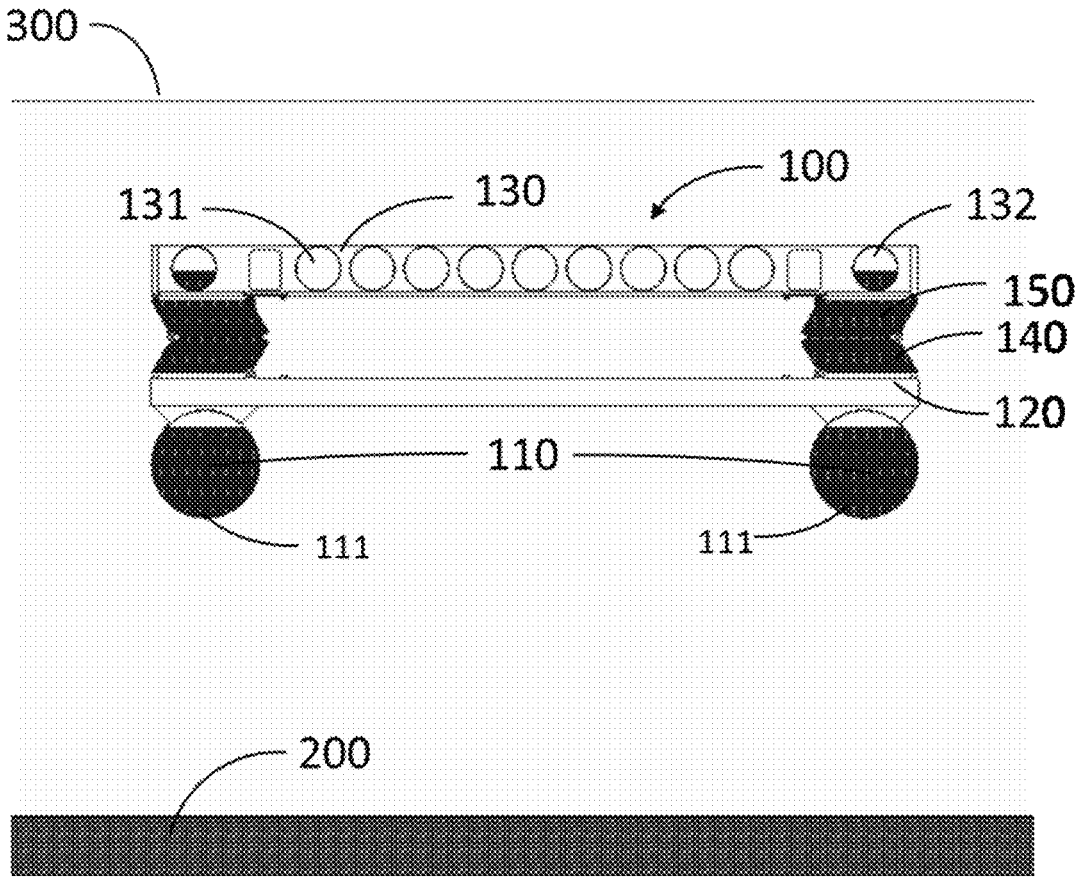
Figure 24:
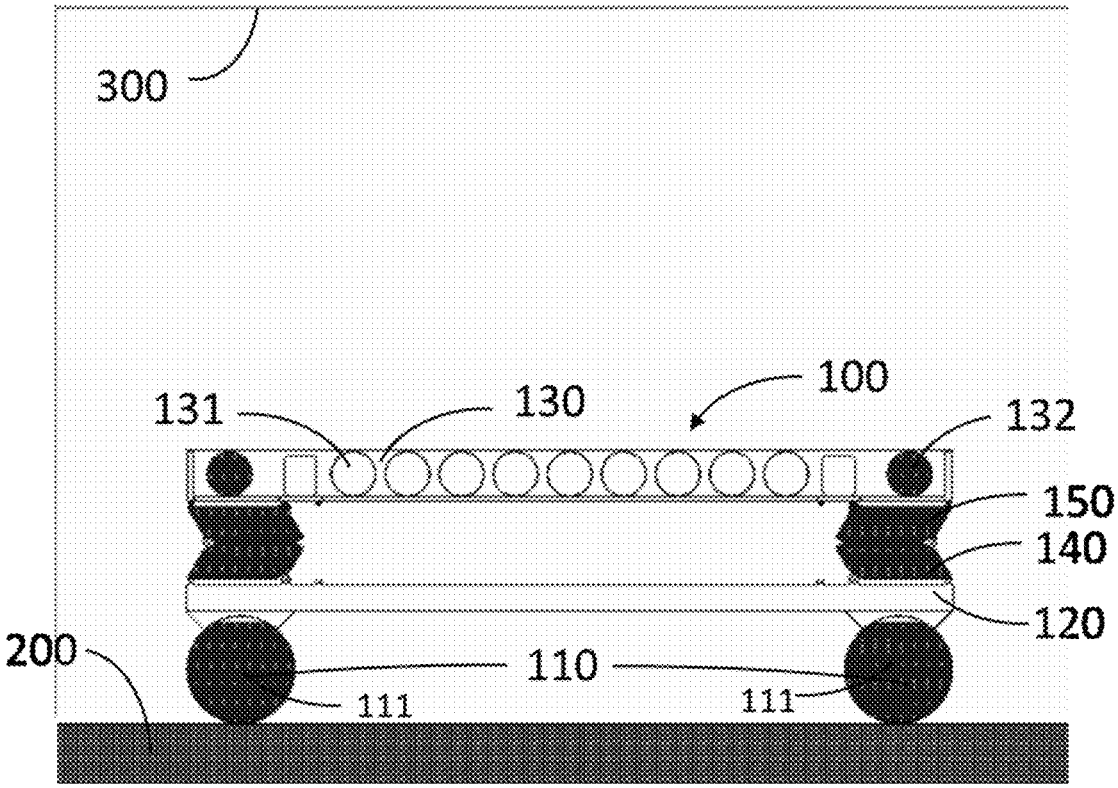

Submergence of the ASOMP 100 from the ocean's surface 300 to the seafloor 200 is depicted in FIG. 18 thru FIG. 24. FIG. 18 depicts the ASOMP 100 configured as a Barge on the ocean's surface 300 with all ballast tanks void of water. FIG. 19 shows the addition of water into Ballast Tanks 111 located in the Lower Hulls 110. When sufficient ballast is added to the Lower Hull 110 Ballast Tanks 111 the vented Lower Strut 140 portions become submerged and fill with sea water as shown in FIG. 20. As the Upper Strut 150 portions are also vented they fill with sea water and the ASOMP 100 continues to submerge until the Main Deck Platform 130 Pressure Vessels 131 and Submergence Control Tanks 132 contact the ocean surface 300 as shown in FIG. 21. Lower Hull Ballast Tanks 111 continue to be filled with ballast water increasing the ASOMP's draft until the Main Deck Platform is almost submerged as shown in FIG. 22. FIG. 23 shows the Submergence Control Tanks 132 being ballasted to control the ASOMP's 100 decent to the seafloor. When reaching the seafloor as shown in FIG. 24 the submergence Control Tanks 132 and the Lower Hull Ballast Tanks 111 continue to be filled with sea water increasing the ASOMP's weight enabling it to maintain its location in a seaway current without the use of an anchoring system. When commanded to surface the ASOMP 100 autonomous Ballasting Control System 180 essentially deballasts the ASOMP 100 by reversing the ballasting sequence used to submerge the ASOMP 100.

Figure 6:
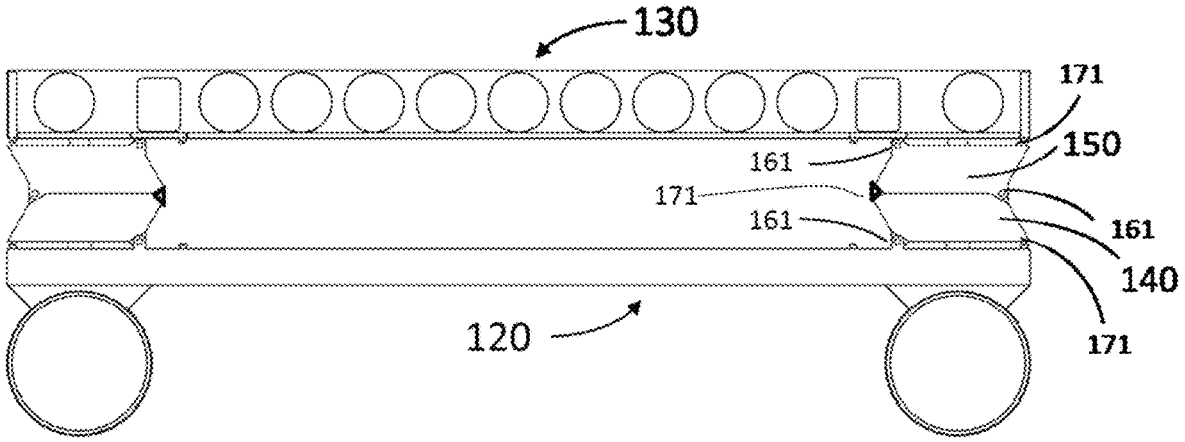
FIG. 6 is a midship section showing the ASOMP configured as a Barge with Struts in a folded position.
Figure 7:
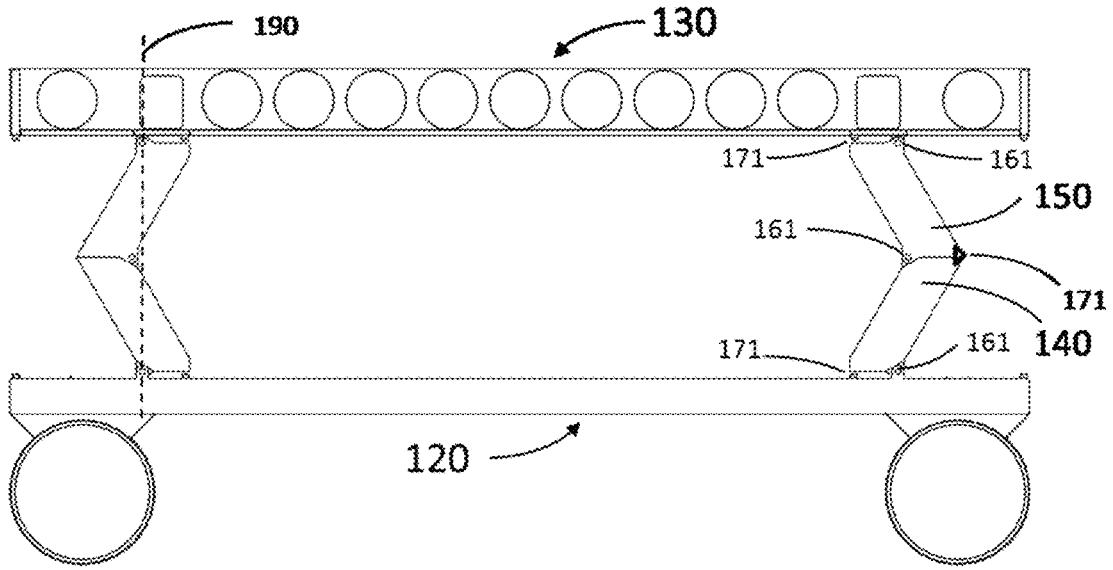
FIG. 7 is a midship section showing the ASOMP configured as SWATH with struts in the extended position.
Figure 8:
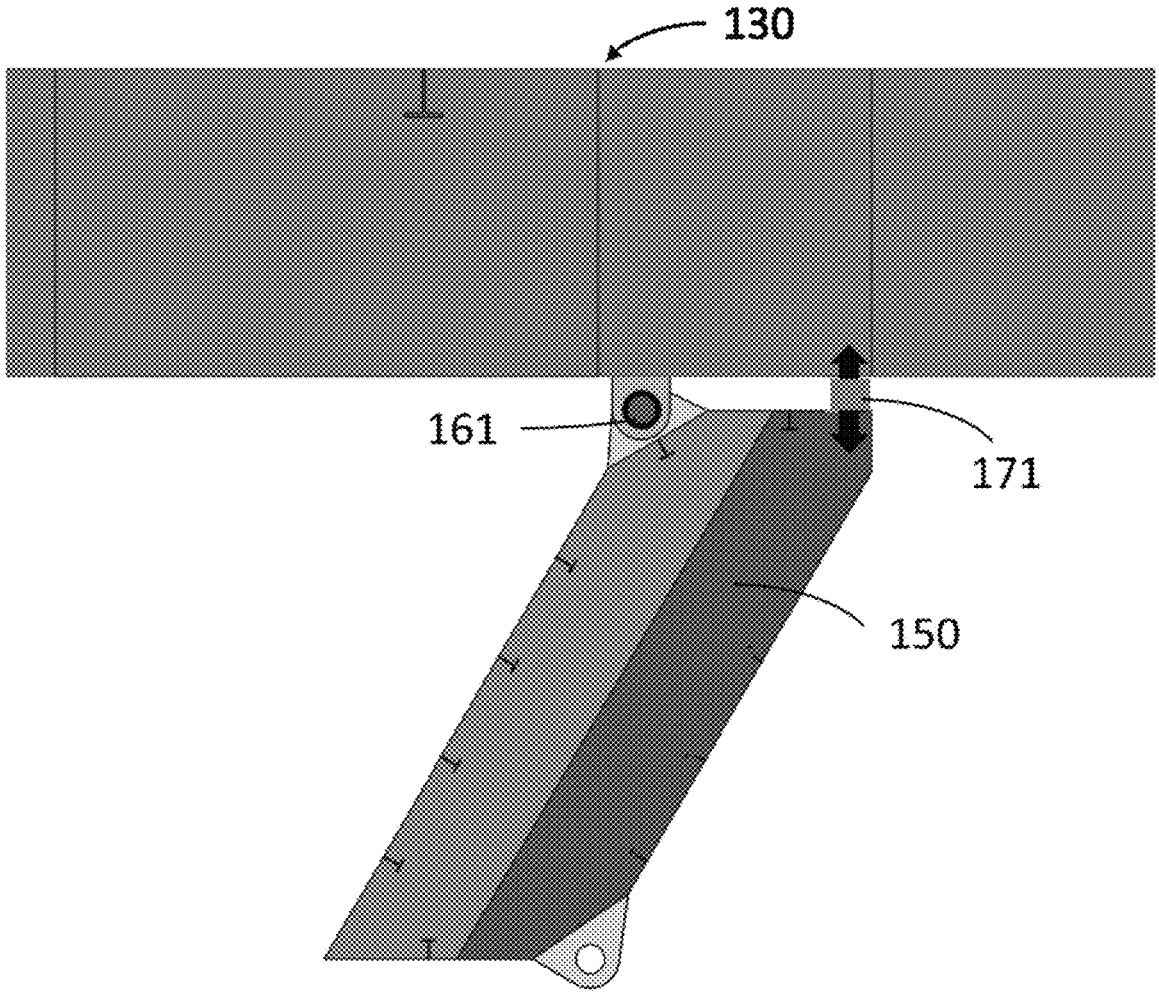
FIG. 8 is a view showing the primary components of the connection between the Strut and Main Deck Platform.
Figure 9:
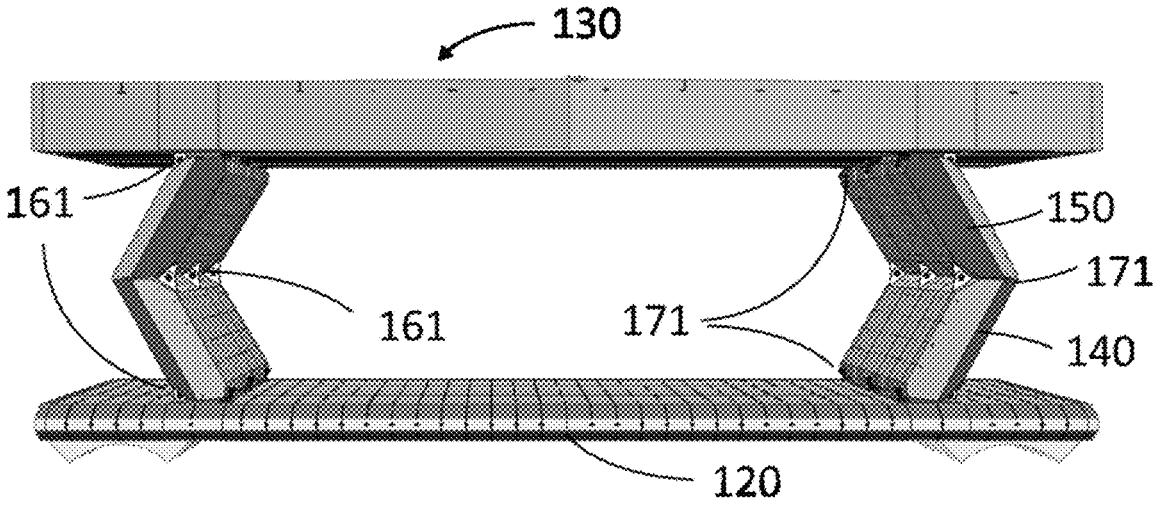
FIG. 9 is a perspective view showing the plurality of connections between the ASOMP's Main Deck Platform, the Strut portions and the Cross Structure.
Figure 25:
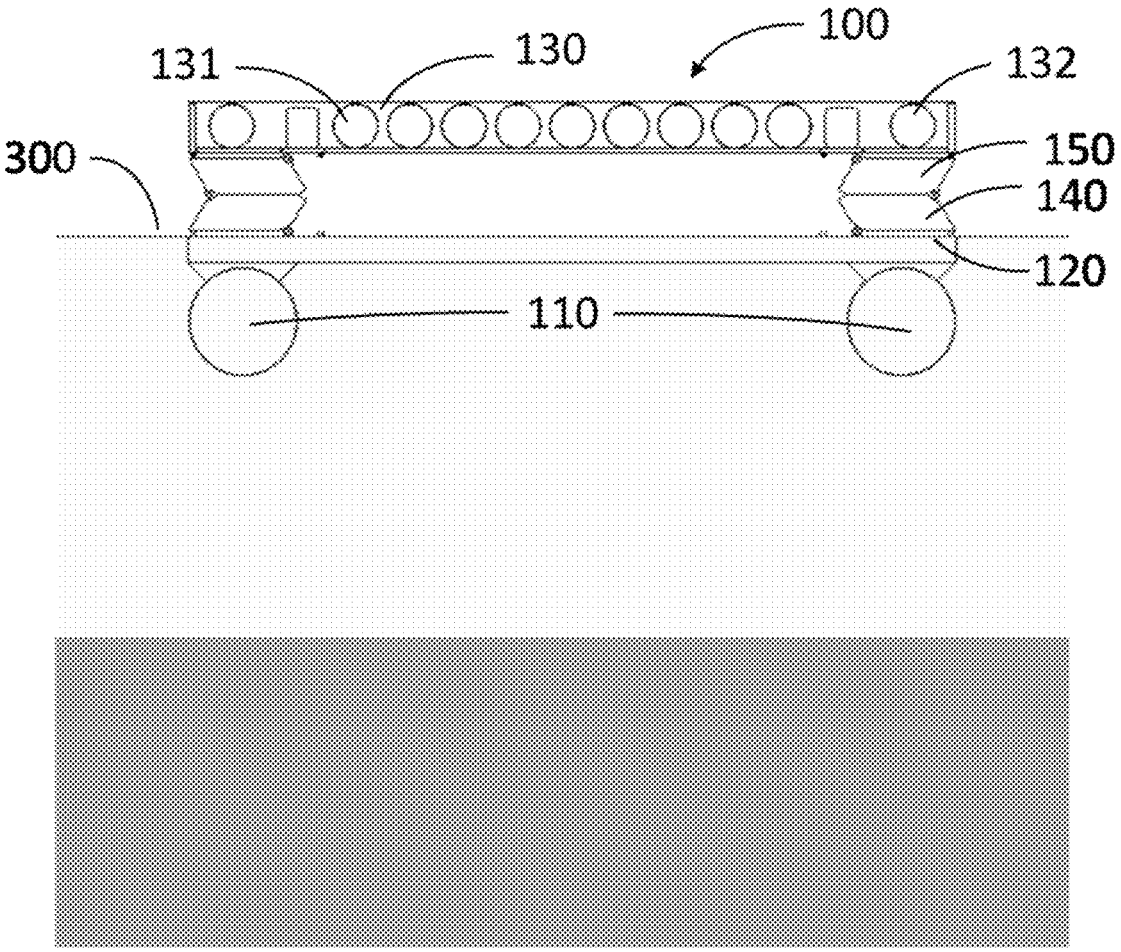
FIGS. 25-29 show the ballasting operations that enable the ASOMP to convert between a Barge and a SWATH.
Figure 26:
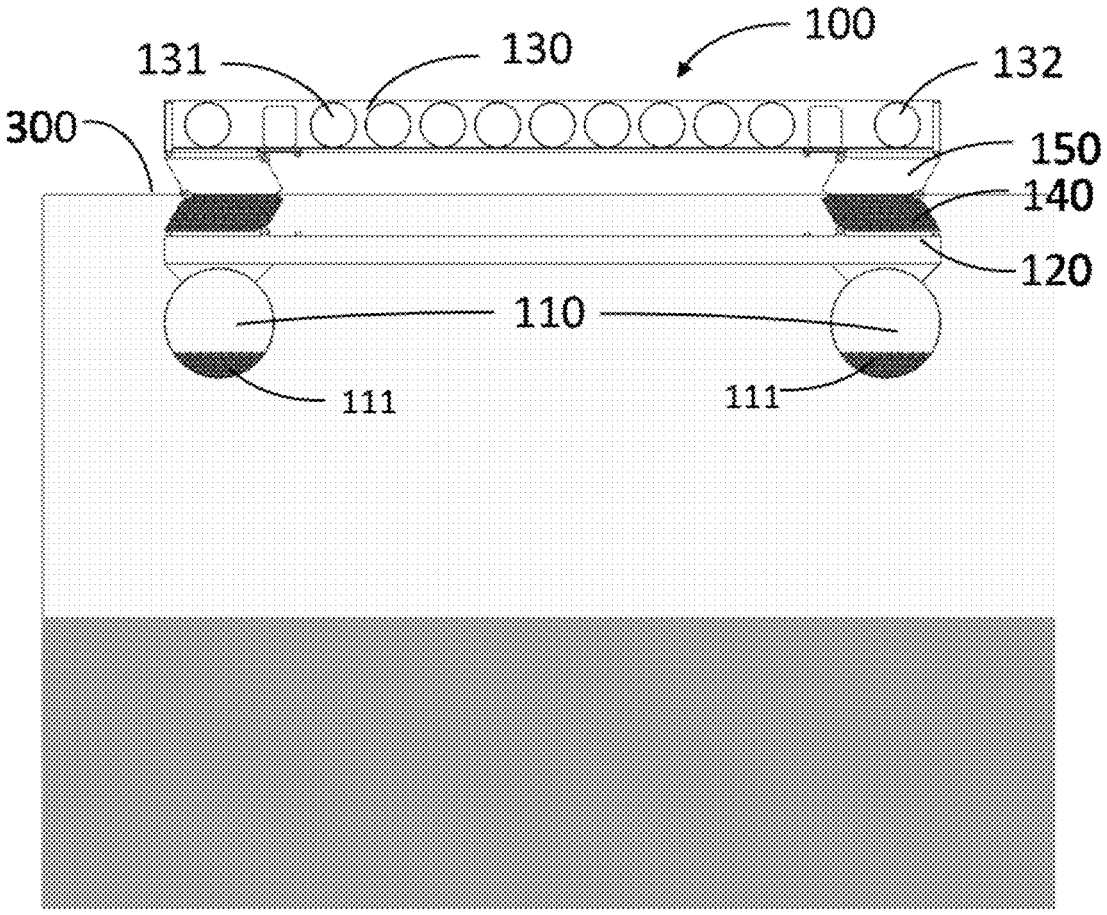
Figure 27:
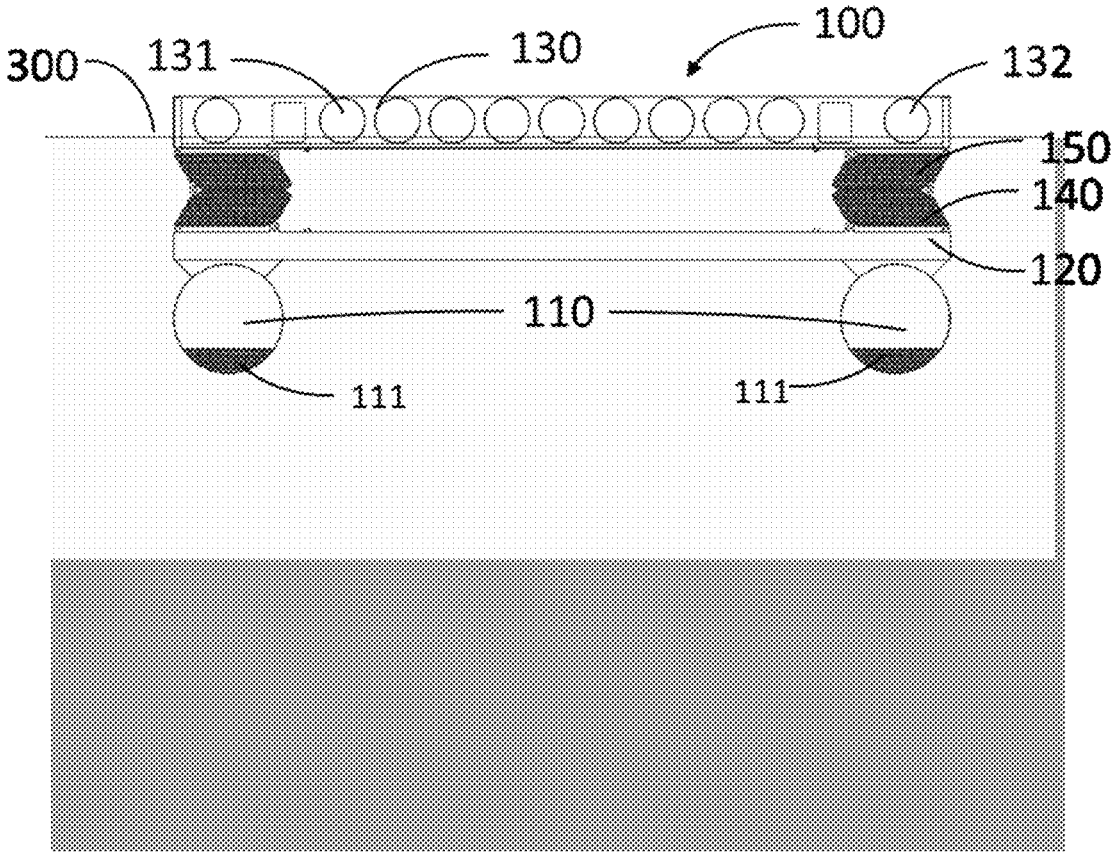
Figure 28:
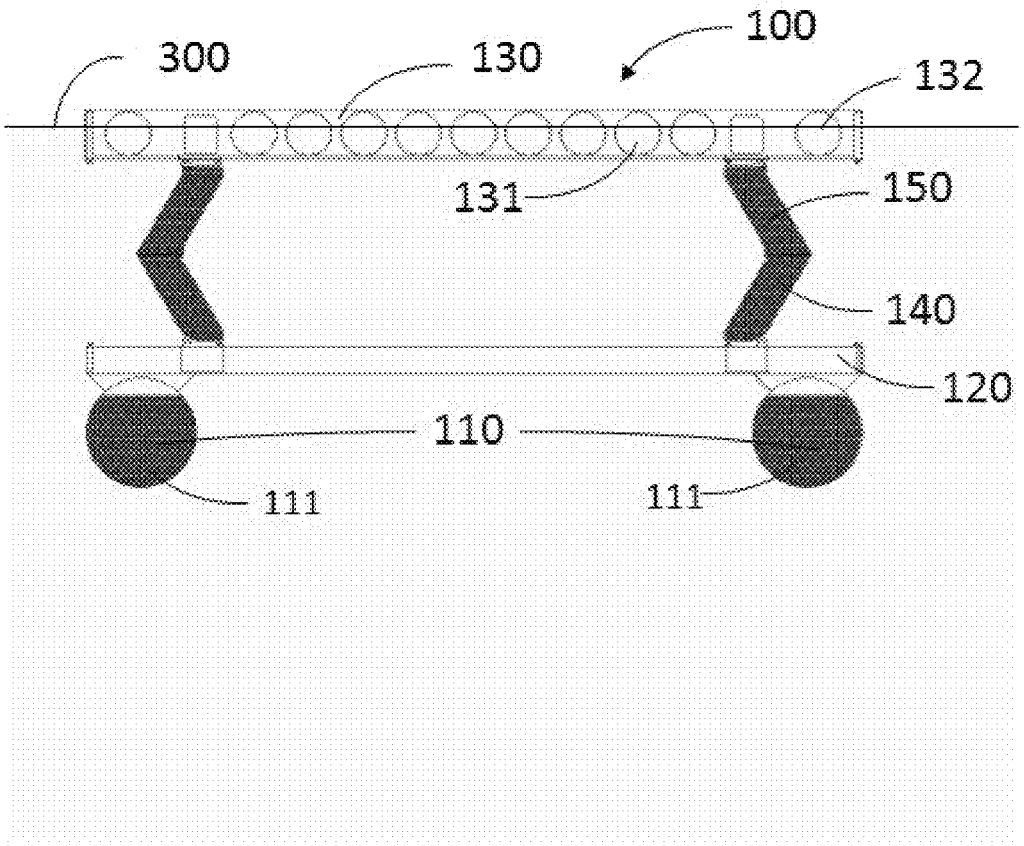
Figure 29:
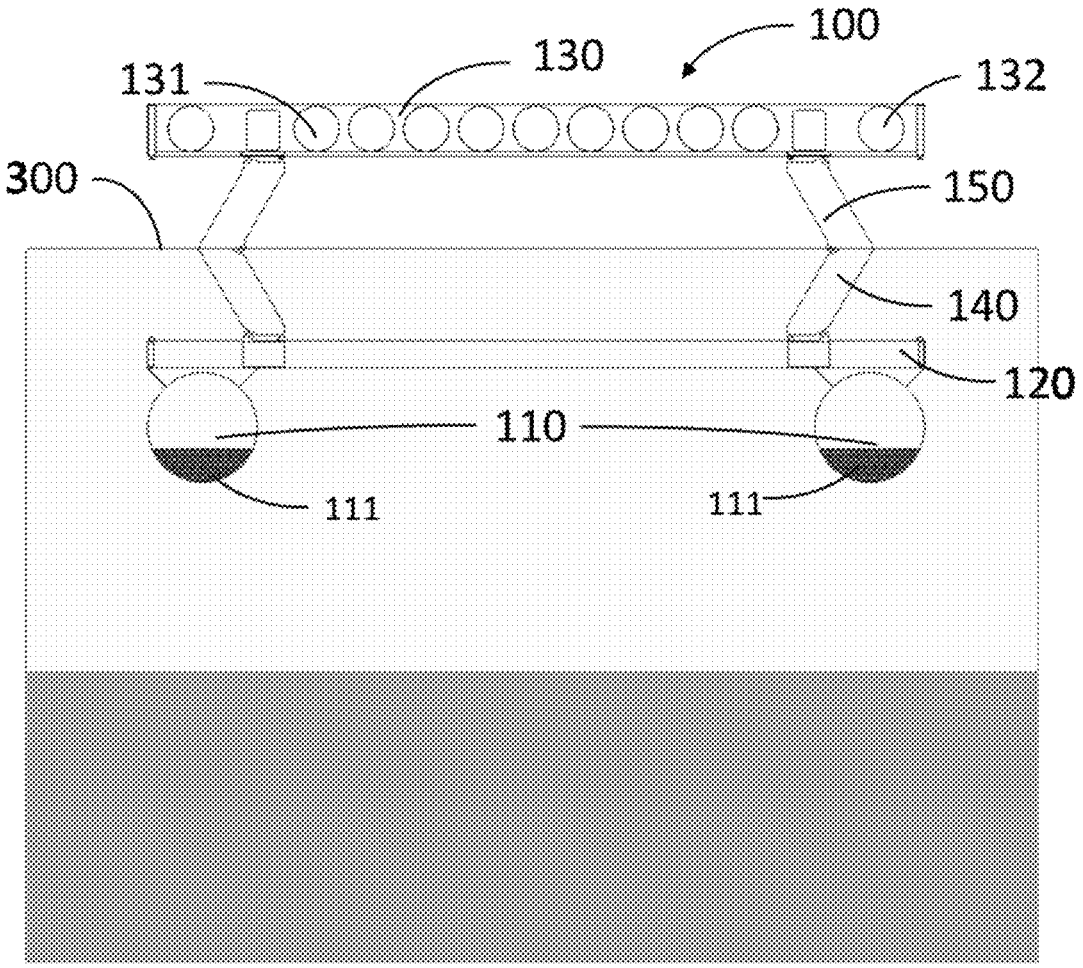

Changing the ASOMP's configuration from the Barge to SWATH is also conducted by the autonomous Ballasting Control System 180 as depicted in FIG. 25 thru FIG. 29. FIG. 25 depicts the ASOMP 100 configured as a Barge on the ocean's surface 300 with all ballast tanks void of water. FIG. 26 shows the addition of water into Ballast Tanks 111 located in the Lower Hulls 110. When sufficient ballast is added to the Lower Hull 110 Ballast Tanks 111 the vented Lower Strut 140 portions become submerged and fill with sea water. As the Upper Strut 150 portions are also vented they fill with sea water and the ASOMP 100 continues to submerge until the Main Deck Platform 130 Pressure Vessels 131 and Submergence Control Tanks 132 contact the ocean surface 300 as shown in FIG. 27. All Pivot Locks 171 shown in FIG. 6 are unlocked allowing the Lower Strut 140 and Upper Strut 150 portions to unfold when additional ballast is added to the Lower Hull Ballast Tanks 111 as shown in FIG. 28. When the Lower Strut 140 and Upper Strut 150 portions are fully extended all Pivot Locks 171 are engaged locking the Lower Strut 140 and Upper Strut 150 portions in the SWATH configuration arrangement as shown in FIG. 28. The Lower Hulls 110 Ballast Tanks 111 are then deballasted raising the ASOMP 110 to the ocean's surface and draining the Lower Strut 140 and Upper Strut 150 portions. After the Lower Strut 140 and Upper Strut 150 valves are closed making them buoyant portions the Lower Hulls 110 Ballast Tanks 111 are then ballasted until the ocean surface waterline 300 is located at the nominal SWATH waterline position between the Lower Strut 140 and Upper Strut 150 portions as shown in FIG. 29. When commanded to convert from the SWATH to the Barge configuration the ASOMP 100 autonomous Ballasting Control System 180 uses a similar ballasting, deballasting and Pivot Lock sequence.

What is claimed is:

1. An Autonomous fully-Submersible Offshore Marine Platform (ASOMP) comprised of: (1) at least two submerged pod shaped Lower Hulls that provide a substantial portion of the ASOMP's buoyancy and ballasting capacity that are of a form able to withstand hydrostatic pressures when submerged; (2) a Cross Structure connecting said Lower Hulls that creates a structural arrangement that significantly reduces the hydrodynamic load created stresses as compared to a conventional SWATH hullform vessel and also generates significant hydrodynamic added mass and damping reducing ASOMP's seaway motions; (3) a Main Deck Platform used to support mission equipment and ASOMP operations that is comprised of (a) an Operational Deck which can be configured to support various mission operations such as a helicopter Vertical Take-Off and Landing (VTOL) flight deck or a roll on roll off cargo deck and pier, (b) a plurality of Pressure Vessels of sufficient capacity (volume and pressure) to enable multiple submergence, surfacing and mode change (SWATH to Barge and vice versa) ASOMP operations, and where the Pressure Vessels provide buoyancy that is greater than the Main Deck Platform's weight and storage of high pressure air (used in lieu of ballast pumps) which along with said Lower Hulls' ballasting capacity and a ballast control system enables the ASOMP to reconfigure, without the use of ballast pumps, between Barge and SWATH modes (within minutes as compared to multiple hours for pump operations) and to operate as both a submersible, where the center of buoyancy must be located above the center of gravity, and a surface vessel (Barge or SWATH) where the center of buoyancy is below the center of gravity, and (c) Submergence Control Tanks used to control submerging and surfacing of the ASOMP that are of a soft tank form (that do not need to withstand the submergence hydrostatic pressure) that are ballasted using tank vents or deballasted using compressed air from said Pressure Vessels; (4) Struts with upper and lower portions, that are pivotally connected to each other, the Main Deck Platform and the Lower Hulls or Cross Structure, and are folded or extended using compressed air stored in the Main Deck Platform Pressure Vessels to ballast or deballast said Lower Hulls enabling the ASOMP to change between Barge and SWATH operational modes by raising or lowering the Main Deck Platform with respect to the Lower Hulls and when the Strut portions are fully extended the pivots connecting the strut upper portion to the strut lower portion must be positioned to not go over center which is defined as a line between the pivots connecting the upper strut portion to the Main Deck Platform and the pivots connecting the lower strut portion to the Cross Structure or Lower Hulls, and when fully extended (SWATH arrangement) or fully folded (Barge arrangement) the strut sections are locked in place; (5) a secure ASOMP command, control and communication system for monitor and control remotely by an off-board control system for both surface operations (RF link or equivalent) and fully-submerged operations (acoustic link or equivalent) and an autonomous command, control and communication system and requisite sensors to effectively enable the ASOMP to autonomously perform transit and in theater mobility, ballasting, hibernation, subsurface operations, deballasting, and surface operations without human assistance and where ASOMP subsystems status can be queried, transmitted and controlled by a remote distant location; (6) an electric plant consisting of a diesel generator or other known electricity generating means, a battery energy storage system that can provide the requisite power, for a period in excess of 1 year, to all ASOMP subsystems; and (7) a ballasting system, that maintains the critical Center of Buoyancy position relative to the Center of Gravity when changing between SWATH and Barge modes and surfacing or submerging the ASOMP, that is comprised of Pressure Vessels storing high pressure air, air compressors that recharge the Main Deck Pressure Vessels when the ASOMP is surfaced, control valves and actuators, pressure regulators and sensors that are all controlled by the autonomous command, control and communication system.

2. An Autonomous fully-Submersible Offshore Marine Platform (ASOMP) of claim 1 wherein propulsion systems are integral to the ASOMP's Lower Hull portions in which one propulsion means would be comprised of a diesel generator, batteries, electric propulsion motors and propellers where when operating on the ocean's surface the propulsion system's diesel generator provides the power for the electric propulsion motors allowing an extensive range and endurance with the diesel generator intake air and exhaust gas being provided by a surface piercing snorkel and when operating in a submerged mode below the ocean's surface the electric drive motors are powered by batteries.

3. An Autonomous fully-Submersible Offshore Marine Platform (ASOMP) of claim 1 wherein Unmanned Underwater Vehicles (UUVs) are used as one means to transport the ASOMP, where by one means the UUVs can be connected to the ASOMP using docking tubes, with inflatable toroidal capture seals, that are attached to the ASOMP's structure and when operating on the ocean's surface the UUVs are powered by a diesel generator and electric propulsion motor allowing an extensive range and endurance where diesel intake air and exhaust gas are provided by the UUVs surface piercing snorkel and when operating in a submerged mode below the ocean's surface the UUVs electric drive motor is powered by batteries which can be augmented by connecting to the ASOMP's battery electrical system, and where the UUVs are detached from the ASOMP after transiting to an operational location so the UUVs can return to its operational base for additional purposes.

4. An Autonomous fully-Submersible Offshore Marine Platform (ASOMP) of claim 1 wherein a portion of the Main Deck Platform Pressure Vessels are configured to contain deployable mission equipment with Pressure Vessel hatches providing access for loading and deploying the mission equipment such as Unmanned Underwater Vehicles UUVs that can be deployed when the ASOMP is submerged, and Unmanned Surface Vehicles USVs and Unmanned Air Vehicles that can be deployed when the ASOMP is surfaced.

5. An Autonomous fully-Submersible Offshore Marine Platform (ASOMP) of claim 1 wherein a portion of the Main Deck Pressure Vessels are configured to provide diesel generator intake air or oxygen and store exhaust gas for diesel-electric propulsion when in a fully-submerged state to augment the batteries and extend the ASOMP fully-submerged range and fully-submerged operations endurance.

6. An Autonomous fully-Submersible Offshore Marine Platform (ASOMP) of claim 1 wherein venting air from ballast tanks is reused by directing and storing said venting air into a Pressure Vessel (PV) where the PV air pressure is less than the ballast tank venting air pressure and when the ballast tank air pressure is lower than any ASOMP PV the air is vented into the seaway.

7. An Autonomous fully-Submersible Offshore Marine Platform (ASOMP) of claim 1 wherein Mission Modules consisting of Pressure Vessels, Soft Tanks or other equipment can be attached to the Operational Deck of the Main Deck Platform either in theater or prior to the ASOMP's deployment and where Pressure Vessels could be configured as habitability units to support manned ASOMP mission operations such as VTOL aircraft support or as storage for Unmanned Aerial Vehicles UAVs and UAV payloads or as diesel generator intake air or oxygen and storage of exhaust gas for electric propulsion when submerged or as storage for supplies.

8. An Autonomous fully-Submersible Offshore Marine Platform (ASOMP) of claim 1 wherein Control surfaces, of known form, can be appended to said Cross Structure or Lower Hulls for longitudinal and lateral directional control.

9. An Autonomous fully-Submersible Offshore Marine Platform (ASOMP) of claim 1 wherein fluid pumps of known form are used to transfer fluids.

10. An autonomous fully-Submersible Offshore Marine Platform (ASOMP) of claim 1 wherein a portion of the Submergence Control Tanks used to control submerging and surfacing of the ASOMP are of a hard tank form.

11. An Autonomous fully-Submersible Offshore Marine Platform (ASOMP) of claim 1 wherein known means are applied to minimize the vessel's observable signatures.

12. Autonomous fully-Submersible Offshore Marine Platforms (ASOMPs) of claim 1 wherein multiple ASOMPs (two or more) are connected to extend the Operational Deck length, where the connection can utilize known means at the Operational Deck's surface level, with the connection allowing pitching motion between the connected ASOMPs while maintaining a nearly continuous deck surface.

13. Autonomous fully-Submersible Offshore Marine Platform (ASOMP) of claim 1 wherein multiple ASOMPs (two or more) are connected to extend the Operational Deck length, where the connection can utilize known means for a rigid connection between the connected ASOMPs while maintaining a nearly continuous deck surface.

14. An Autonomous fully-Submersible Offshore Marine Platform (ASOMP) of claim 1 wherein said Submergence Control Tanks used to control submerging and surfacing of the ASOMP configure said Main Deck Platform to be partially submerged at an angle (inclined) to the water surface to provide a ramp (beach mode) enabling launching and landing of amphibious vehicles.

15. An Autonomous fully-Submersible Offshore Marine Platform (ASOMP) comprised of: (1) at least two submerged pod shaped Lower Hulls that provide a substantial portion of the ASOMP's buoyancy and ballasting capacity that are of a form able to withstand hydrostatic pressures when submerged; (2) a Cross Structure connecting said Lower Hulls that creates a structural arrangement that significantly reduces the hydrodynamic load created stresses as compared to a conventional SWATH hullform vessel and also generates significant hydrodynamic added mass and damping reducing ASOMP's seaway motions; (3) a Main Deck Platform used to support mission equipment and ASOMP operations that is comprised of (a) an Operational Deck which can be configured to support various mission operations, (b) a plurality of Pressure Vessels of sufficient capacity (volume and pressure) to enable multiple submergence, surfacing and ASOMP operations, and where the Pressure Vessels provide buoyancy that is greater than the Main Deck Platform's weight and storage of high pressure air which along with said Lower Hulls' ballasting capacity and a ballast control system enables the ASOMP to reconfigure to operate as both a submersible, where the center of buoyancy must be located above the center of gravity, and a surface vessel where the center of buoyancy is below the center of gravity, and (c) Submergence Control Tanks used to control submerging and surfacing of the ASOMP; (4) Struts that are of a known Small Waterplane Area Twin Hull (SWATH) form connected to the Main Deck Platform and the Lower Hulls or Cross Structure, and where said struts can be ballasted or deballasted along with said Submergence Control Tanks and Lower Hull Ballast Tanks enabling the ASOMP to change between surface and submerged vessel operational modes; (5) a secure ASOMP command, control and communication system for monitor and control remotely by an off-board control system for both surface operations (RF link or equivalent) and fully-submerged operations (acoustic link or equivalent) and an autonomous command, control and communication system and requisite sensors to effectively enable the ASOMP to autonomously perform transit and in theater mobility, ballasting, hibernation, subsurface operations, deballasting, and surface operations without human assistance and where ASOMP subsystems status can be queried, transmitted and controlled by a remote distant location; (6) an electric plant consisting of a diesel generator or other known electricity generating means, a battery energy storage system that can provide the requisite power to all ASOMP subsystems; and (7) a ballasting system, that maintains the critical Center of Buoyancy position relative to the Center of Gravity when changing between surfacing or submerging the ASOMP, that is comprised of Pressure Vessels storing high pressure air, air compressors that recharge the Main Deck Pressure Vessels when the ASOMP is surfaced, control valves and actuators, pressure regulators and sensors that are all controlled by the autonomous command, control and communication system.

16. An Autonomous fully-Submersible Offshore Marine Platform (ASOMP) of claim 15 wherein propulsion systems are integral to the ASOMP's Lower Hull portions in which one propulsion means would be comprised of a diesel generator, batteries, electric propulsion motors and propellers where when operating on the ocean's surface the propulsion system's diesel generator provides the power for the electric propulsion motors allowing an extensive range and endurance with the diesel generator intake air and exhaust gas being provided by a surface piercing snorkel and when operating in a submerged mode below the ocean's surface the electric drive motors are powered by batteries.

17. An Autonomous fully-Submersible Offshore Marine Platform (ASOMP) of claim 15 wherein Unmanned Underwater Vehicles (UUVs) are used as one means to transport the ASOMP, where by one means the UUVs are connected to the ASOMP using docking tubes, with inflatable toroidal capture seals, that are attached to the ASOMP's structure and when operating on the ocean's surface the UUVs are powered by a diesel generator and electric propulsion motor allowing an extensive range and endurance where diesel intake air and exhaust gas are provided by the UUVs surface piercing snorkel and when operating in a submerged mode below the ocean's surface the UUVs electric drive motor is powered by batteries which can be augmented by connecting to the ASOMP's battery electrical system, and where the UUVs are detached from the ASOMP after transiting to an operational location so the UUVs can return to its operational base for additional purposes.

18. An Autonomous fully-Submersible Offshore Marine Platform (ASOMP) of claim 15 wherein a portion of the Main Deck Platform Pressure Vessels are configured to contain deployable mission equipment with Pressure Vessel hatches providing access for loading and deploying the mission equipment such as Unmanned Underwater Vehicles UUVs that can be deployed when the ASOMP is submerged, and Unmanned Surface Vehicles USVs and Unmanned Air Vehicles that can be deployed when the ASOMP is surfaced.

19. An Autonomous fully-Submersible Offshore Marine Platform (ASOMP) of claim 15 wherein a portion of the Main Deck Pressure Vessels are configured to provide diesel generator intake air or oxygen and store exhaust gas for diesel-electric propulsion when in a fully-submerged state to augment the batteries and extend the ASOMP fully-submerged range and fully-submerged operations endurance.

20. An Autonomous fully-Submersible Offshore Marine Platform (ASOMP) of claim 15 wherein venting air from ballast tanks is reused by directing and storing said venting air into a Pressure Vessel (PV) where the PV air pressure is less than the ballast tank venting air pressure and when the ballast tank air pressure is lower than any ASOMP PV the air is vented into the seaway.

21. An Autonomous fully-Submersible Offshore Marine Platform (ASOMP) of claim 15 wherein Mission Modules consisting of Pressure Vessels, Soft Tanks or other equipment can be attached to the Operational Deck of the Main Deck Platform either in theater or prior to the ASOMP's deployment and where Pressure Vessels could be configured as habitability units to support manned ASOMP mission operations such as VTOL aircraft support or as storage for Unmanned Aerial Vehicles UAVs and UAV payloads or as diesel generator intake air or oxygen and storage of exhaust gas for electric propulsion when submerged or as storage for supplies.

22. An Autonomous fully-Submersible Offshore Marine Platform (ASOMP) of claim 15 wherein Control surfaces, of known form, can be appended to said Cross Structure, Struts or Lower Hulls for longitudinal and lateral directional control.

23. An Autonomous fully-Submersible Offshore Marine Platform (ASOMP) of claim 15 wherein fluid pumps of known form are used to transfer fluids.

24. An autonomous fully-Submersible Offshore Marine Platform (ASOMP) of claim 15 wherein a portion of the Submergence Control Tanks used to control submerging and surfacing of the ASOMP are of a hard tank form.

25. An Autonomous fully-Submersible Offshore Marine Platform (ASOMP) of claim 15 wherein known means are applied to minimize the vessel's observable signatures.

26. Autonomous fully-Submersible Offshore Marine Platforms (ASOMPs) of claim 15 wherein multiple ASOMPs (two or more) are connected to extend the Operational Deck length, where the connection can utilize known means at the Operational Deck's surface level, with the connection allowing pitching motion between the connected ASOMPs while maintaining a nearly continuous deck surface.

27. Autonomous fully-Submersible Offshore Marine Platform (ASOMP) of claim 15 wherein multiple ASOMPs (two or more) are connected to extend the Operational Deck length, where the connection can utilize known means for a rigid connection between the connected ASOMPs while maintaining a nearly continuous deck surface.

28. An Autonomous fully-Submersible Offshore Marine Platform (ASOMP) of claim 15 wherein said Submergence Control Tanks used to control submerging and surfacing of the ASOMP configure said Main Deck Platform to be partially submerged at an angle (inclined) to the water surface to provide a ramp (beach mode) enabling launching and landing of amphibious vehicles.

* * * * *